US007444933B2

(12) United States Patent
Kidoura et al.

(10) Patent No.: US 7,444,933 B2
(45) Date of Patent: Nov. 4, 2008

(54) STENCIL PRINTER

(75) Inventors: Yasunobu Kidoura, Miyagi (JP); Yoshiyuki Shishido, Miyagi (JP); Yasumitsu Yokoyama, Miyagi (JP); Satoshi Katoh, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/898,331

(22) Filed: Jul. 26, 2004

(65) Prior Publication Data

US 2005/0000375 A1 Jan. 6, 2005

Related U.S. Application Data

(62) Division of application No. 09/986,281, filed on Nov. 8, 2001, now Pat. No. 6,786,146.

(30) Foreign Application Priority Data

Nov. 8, 2000 (JP) ..... 2000-340674
Nov. 9, 2000 (JP) ..... 2000-341969

(51) Int. Cl.
*B41C 1/14* (2006.01)

(52) U.S. Cl. ..... 101/128.4; 101/116

(58) Field of Classification Search ..... 101/114, 101/115, 116, 128.21, 128.4, 129
See application file for complete search history.

(56) References Cited

U.S. PATENT DOCUMENTS

| | | | | |
|---|---|---|---|---|
| 5,454,309 | A * | 10/1995 | Fujikawa et al. | 101/128.21 |
| 5,551,337 | A | 9/1996 | Miki et al. | |
| 5,963,241 | A | 10/1999 | Higa et al. | |

FOREIGN PATENT DOCUMENTS

| | | |
|---|---|---|
| JP | 6-320851 | 11/1994 |
| JP | 8-90747 | 4/1996 |
| JP | 9-277686 | 10/1997 |
| JP | 11-20983 | 1/1999 |
| JP | 11-91227 | 4/1999 |
| JP | 11-115145 | 4/1999 |
| JP | 11-115148 | 4/1999 |

* cited by examiner

*Primary Examiner*—Ren Yan
(74) *Attorney, Agent, or Firm*—Oblon, Spivak, McClelland, Maier & Neustadt, P.C.

(57) ABSTRACT

A stencil printer of the present invention perforates, or cuts, a thermosensitive stencil with a thermal head to thereby make a master. The stencil printer includes a stencil distinguishing device for automatically identifying the kind of the stencil or a master setting device for allowing the operator of the printer to set the kind of the stencil. An adjusting device selects, among master making conditions experimentally determined beforehand, a master making condition matching with information output from the stencil distinguishing device or the stencil setting device. The operator can easily change the master making condition in accordance with the kind of a stencil to use.

20 Claims, 28 Drawing Sheets

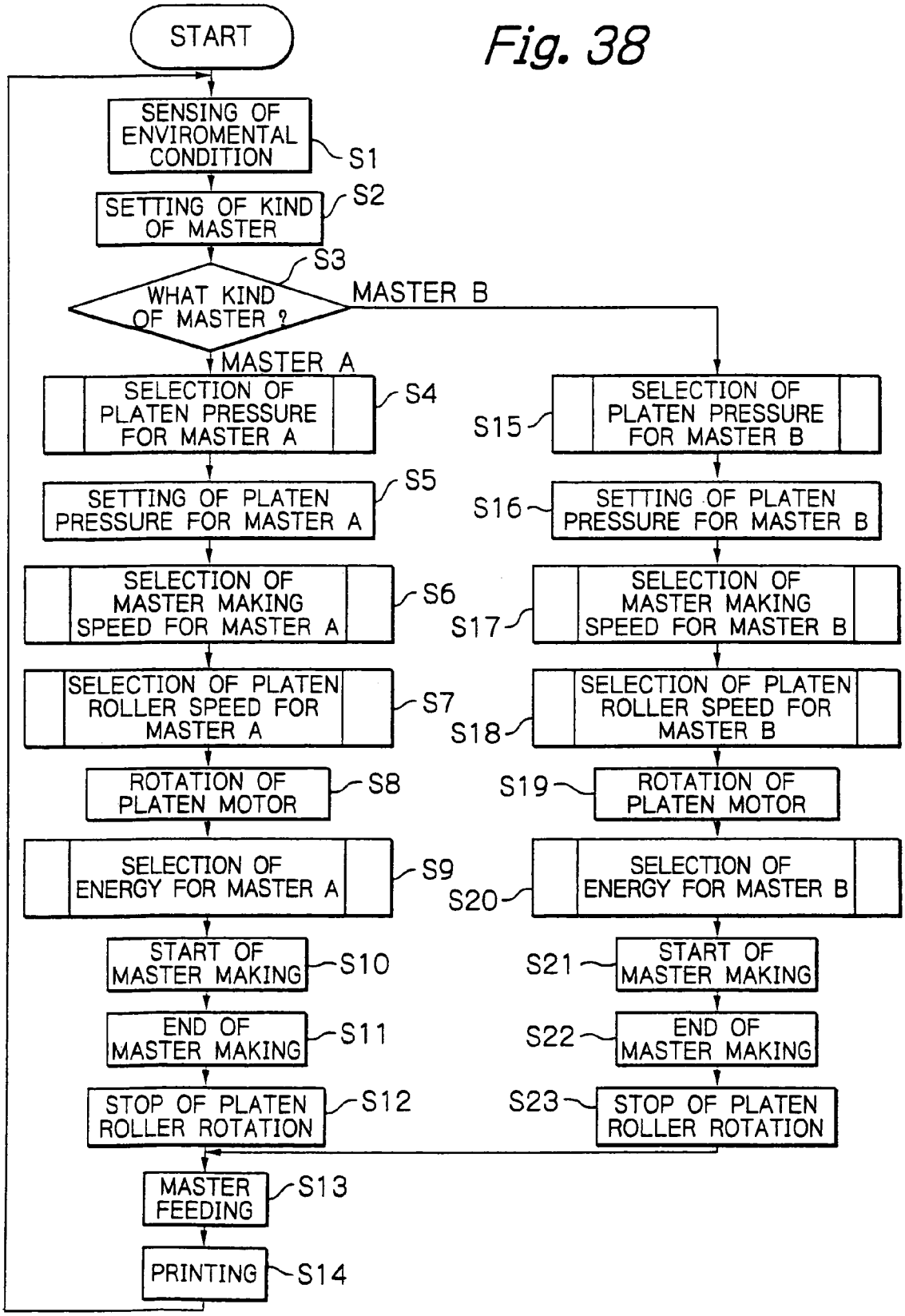
Fig. 38
START
SENSING OF ENVIROMENTAL CONDITION
S1
SETTING OF KIND OF MASTER
S2
S3
WHAT KIND OF MASTER ?
MASTER B
MASTER A
SELECTION OF PLATEN PRESSURE FOR MASTER A
S4
SETTING OF PLATEN PRESSURE FOR MASTER A
S5
SELECTION OF MASTER MAKING SPEED FOR MASTER A
S6
SELECTION OF PLATEN ROLLER SPEED FOR MASTER A
S7
ROTATION OF PLATEN MOTOR
S8
SELECTION OF ENERGY FOR MASTER A
S9
START OF MASTER MAKING
S10
END OF MASTER MAKING
S11
STOP OF PLATEN ROLLER ROTATION
S12
MASTER FEEDING
S13
PRINTING
S14
S15
SELECTION OF PLATEN PRESSURE FOR MASTER B
S16
SETTING OF PLATEN PRESSURE FOR MASTER B
S17
SELECTION OF MASTER MAKING SPEED FOR MASTER B
S18
SELECTION OF PLATEN ROLLER SPEED FOR MASTER B
S19
ROTATION OF PLATEN MOTOR
S20
SELECTION OF ENERGY FOR MASTER B
S21
START OF MASTER MAKING
S22
END OF MASTER MAKING
S23
STOP OF PLATEN ROLLER ROTATION

STENCIL PRINTER

BACKGROUND OF THE INVENTION

1. Field of the Invention

The present invention relates to a stencil printer for printing an image on a sheet via a master wrapped around a print drum.

2. Description of the Background Art

A thermosensitive stencil for use with a stencil printer has a laminate structure made up of a 1 μm to 8 μm thick, thermoplastic resin film and a porous base adhered to one side of the resin film. The porous base is formed of Japanese paper, synthetic fibers or a mixture thereof.

A digital stencil printer includes a thermal head or similar heating means that perforates, or cuts, the film surface of the stencil with heat in accordance with digital image data representative of a document image. After the perforated stencil, i.e., a master has been wrapped around a print drum, ink is fed from the inside of the print drum while a press roller or similar pressing member presses a sheet against the print drum. As a result, the ink is transferred from the print drum to the sheet via the perforations of the master.

Assume that the heating means is implemented as a thermal head. Then, a platen roller, which faces the thermal head, is rotated to convey the stencil positioned between the heating surface of the head and the platen roller. Generally, a pressing mechanism presses the thermal head against the platen roller to thereby generate platen pressure, which presses the stencil against the heating surface of the thermal head.

Thermosensitive stencils in general are classified into some different kinds by the thickness of the thermoplastic resin film, the material of the porous base, the kind and the amount of an anti-sticking agent or an antistatic agent coated on the side of the film to be perforated and so forth. Each stencil printer, strictly a master making device included therein, has heretofore been operable only with a particular kind of stencil.

More specifically, when different kinds of stencils are applied to a single master making device, a conveying distance differs from one stencil to another stencil and effects the reproducibility of the size of an image, as well known in the art. This is because slip between the film surface of the stencil and the surface of the thermal head and friction to act between the porous base of the stencil and the platen roller depend on the kind of the stencil. Further, a load to act during perforation due to a master making speed and image density also has influence on the reproducibility of an image size. In addition, the front tension and back tension of the stencil effect the reproducibility of an image size. When such factors are brought out of balance, the stencil conveying distance varies due to changes in slip, friction and load.

The degree of slip varies in accordance with the surface configuration of the thermal head, e.g., the material and smoothness of a protection film and the material of the porous base adhered to the stencil. Other factors that effect slip include the kind and the amount of the anti-sticking agent, antistatic agent or similar overcoat agent coated on the film of the stencil, the material and the amount of a filler contained in the film, and the thickness of the film. The anti-sticking agent promotes slip between the surface of the thermal head and the film while the antistatic agent reduces charging to occur during the conveyance of the stencil.

The degree of friction varies in accordance with the material, surface configuration, rubber hardness and other factors of the platen roller and the kind of the porous support. Other factors that effect friction include the kind and density of the porous base, the kind and the amount of an overcoat agent contained in the base, and the amount of an overcoat agent, which is coated on the film surface, migrated from the film surface to the base when the stencil is rolled up.

A load increases with an increase in image density on a single line and with an increase in master making speed. Further, a load is proportional to the front tension and back tension of the stencil.

When a single master making device conveys a stencil, the thickness of the stencil and the amount of crush of the stencil ascribable to pressure have influence on the conveying distance, too.

Another factor that effects the conveying distance is the environmental conditions. For example, when ambient temperature rises, the diameter of the platen roller increases due to thermal expansion and causes the peripheral speed of the roller to vary. Particularly, when the porous base is hygroscopic, friction to act between the platen roller and the base varies in accordance with humidity and also effects the conveying distance.

The prerequisite with master making is that the thermal head surely perforates the film of the stencil by melting it with heat. Close adhesion between the film surface and the heating elements of the thermal head is one of various factors having influence on the perforation condition. The degree of close adhesion determines a perforation condition and sometimes leaves the film left unperforated. As for the printer body, irregularity in the amounts of heat generated by the heating elements of the thermal head, platen pressure and the surface configuration of the platen roller effect close adhesion.

Specifically, assume that a single master making device with a fixed platen pressure operates with a stencil that cannot be desirably perforated without resorting to high platen pressure and a stencil that can be done so even at low platen pressure. Then, the platen pressure must be matched to the former kind of stencil, but such a platen pressure is excessively high for the latter kind of stencil. The excessive platen pressure causes more than a necessary mechanical stress to act on the thermal head and is not desirable from the standpoint of durability, e.g., wear resistance of the thermal head.

Further, a greater amount of adhesive for adhering the film and porous base must be used when the platen pressure is high than when it is optimum (low); otherwise, the film and base would separate from each other when conveyed between the thermal head and the platen roller. This not only wastes the adhesive, but also adversely effects the perforation condition.

Assume that the same energy is applied to the thermal head when different kinds of stencils are used. Then, the perforation condition sometimes differs and sometimes remains the same, but is not optimum, depending on so-called stencil (film) sensitivity that is determined by the material, thickness and so forth of the film.

To reduce offset particular to a stencil printer, the perforation diameter of the film should preferably be small although the density of a print should be taken into account. However, when porous base has low ink permeability, the perforation diameter of the film must be large enough to transfer a sufficient amount of ink to a sheet; otherwise, the resulting image density would be short.

Master making conditions differ from one kind of stencil to another kind of stencil, as stated above. Therefore, when the user selects a particular kind of stencil by attaching importance to, e.g., image quality or the cost of the stencil itself, the user must vary the various conditions of the master making device one by one in matching relation to the kind of the master. This cannot be done without resorting to expertness or troublesome work. This is why the user has heretofore been obliged to use only a stencil matching with conditions set at the time of delivery.

Technologies relating to the present invention are disclosed in, e.g., Japanese Patent Laid-Open Publication Nos. 11-115145, 11-115148, 6-320851, 8-090747, 9-277686, 11-020983, and 11-091227.

SUMMARY OF THE INVENTION

It is an object of the present invention to provide a stencil printer capable of easily, automatically setting master making conditions matching with a desired kind of stencil, and promoting diversification from the user standpoint.

A stencil printer of the present invention perforates, or cuts, a thermosensitive stencil with a thermal head to thereby make a master. The stencil printer includes a stencil distinguishing device for automatically identifying the kind of the stencil or a master setting device for allowing the operator of the printer to set the kind of the stencil. An adjusting device selects, among master making conditions experimentally determined beforehand, a master making condition matching with information output from the stencil distinguishing device or the stencil setting device. The operator can easily change the master making condition in accordance with the kind of a stencil to use.

BRIEF DESCRIPTION OF THE DRAWINGS

The above and other objects, features and advantages of the present invention will become more apparent from the following detailed description taken with the accompanying drawings in which:

FIG. 38 is a flowchart showing a specific combined operation of the fourteenth to twenty-seventh embodiments.

DESCRIPTION OF THE PREFERRED EMBODIMENTS

Figure 1:
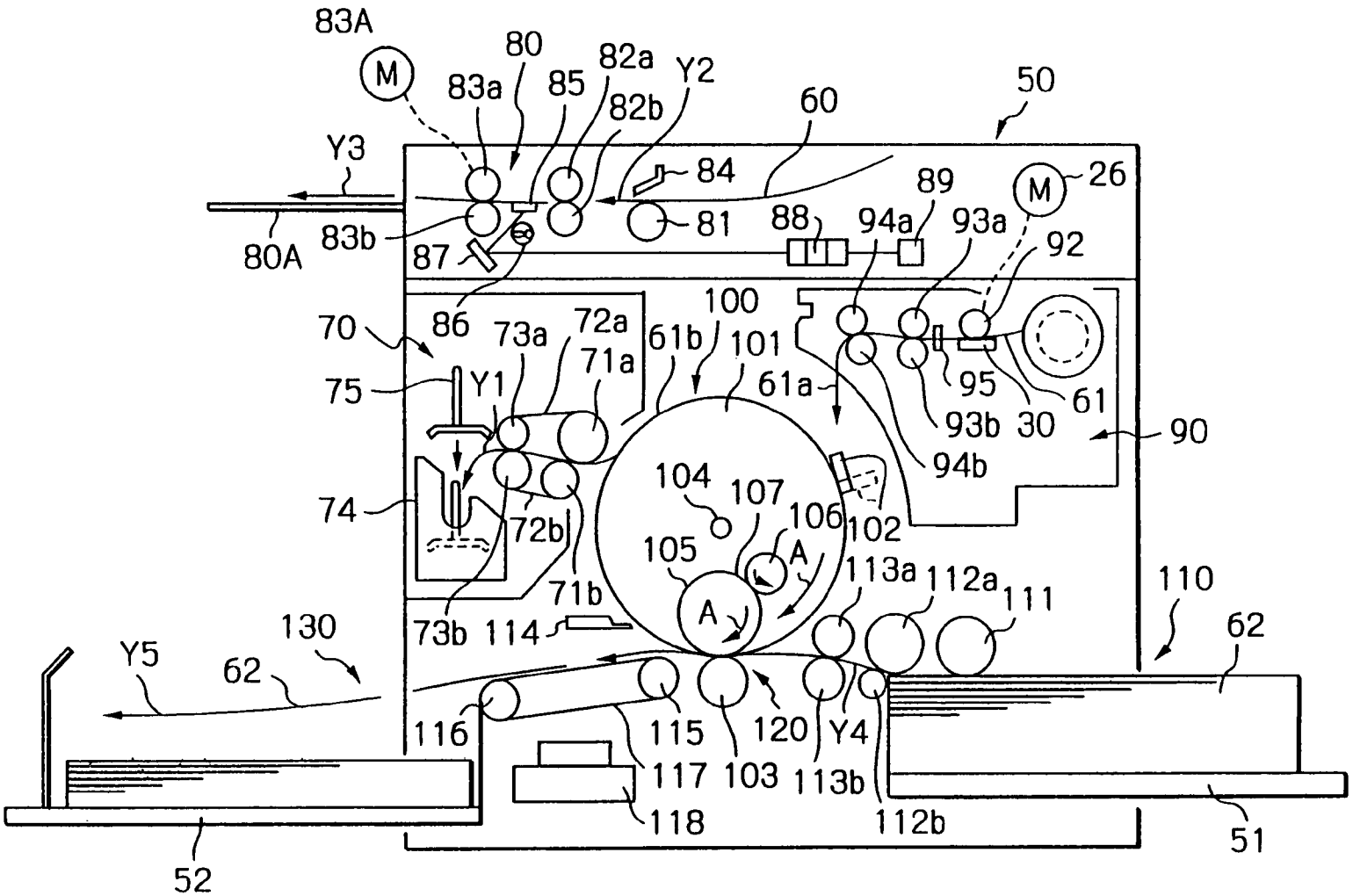
FIG. 1 is a view showing the general construction of a stencil printer to which the present invention is applied.

Referring to FIG. 1 of the drawings, a stencil printer to which the present invention is applicable is shown. As shown, the stencil printer includes a cabinet or housing 50. A document reading section 80 is arranged in the upper portion of the cabinet 50. A master making device 90 is positioned below the scanner 80. A printing section 100 is positioned at the left-hand side of the master making device 90, as viewed in FIG. 1, and includes a print drum 101 having a porous portion. A master discharging section 70 is located at the left-hand side of the printing section 100, as viewed in FIG. 1. A sheet feeding section 110 is positioned below the master making device 90, as viewed in FIG. 1. A pressing section 120 is positioned below the print drum 101, as viewed in FIG. 1. Further, a sheet discharging section 130 is arranged in the lower left portion of the cabinet 50.

In operation, the operator of the printer lays a document 60 on a document tray, not shown, and then presses a perforation start key not shown. In response, a master discharging step begins. Specifically, a master 61*b* used for the last printing operation is left on the circumference of the print drum 101.

At the beginning of the master discharging step, the print drum 101 is caused to rotate counterclockwise, as viewed in FIG. 1. As the trailing edge of the used master 61*b* approaches a pair of peel rollers 71*a* and 71*b*, which are in rotation, the peel roller 71*b* pucks up the trailing edge of the used master 61*b*. A pair of discharge rollers 73*a* and 73*b* are positioned at the left-hand side of the peel rollers 71*a* and 71*b*, as viewed in FIG. 1. A pair of endless belts 72*a* and 72*b* are respectively passed over the peel roller 71*a* and discharge roller 73*a* and the peel roller 71*b* and discharge roller 73*b*. The belts 72*a* and 72*b* cooperate to convey the used master 61*b* to a waste master box 74 in a direction indicated by an arrow Y1 in FIG. 1. Consequently, the used master 61*b* is peeled off from the drum 101 and collected in the waster master box 74. At this time, the print drum 101 is continuously rotated counterclockwise. A compression plate 75 compresses the used master 61*b* collected in the waster master box 74.

The document reading section 80 reads the document in parallel with the master discharging step described above. Specifically, a separator roller 81, a pair of front feed rollers 82*a* and 82*b* and a pair of rear feed rollers 83*a* and 83*b* in rotation sequentially convey the document 60 in contiguous directions Y2 and Y3, allowing the document reading section 80 to read the document 60. If two or more documents are stacked on the document tray, then a blade 84 cooperates with the separator roller 81 to cause only the bottom document to be paid out from the document tray. A feed roller motor 83A causes the rear feed roller 83*a* to rotate. The rear feed roller 83*a*, in turn, drives the front feed roller 82*a* via a timing belt, not shown, passed over the rollers 83*a* and 82*a*. The feed rollers 82*b* and 83*b* are driven rollers.

More specifically, while the document 60 is conveyed along a glass platen 85, a fluorescent lamp 86 illuminates the document 60. The resulting imagewise reflection from the document 60 is reflected by a mirror 87 and then incident to a CCD (Charge Coupled Device) image sensor or similar image sensor 89 via a lens 88. The document reading section 80 is so configured as to read the document 60 with a conventional reduction system. The document 60 fully read is driven out to a tray 80A. An electric signal output from the image sensor or photoelectric transducer 89 is input to an analog-to-digital (AD) converter, not shown and converted to digital image data thereby.

The master making section 90 executes a master making and feeding step in parallel with the image reading operation in accordance with the digital image data. Specifically, A thermosensitive stencil 61 is paid out from a roll and set at a preselected position in the master making device 90. A platen roller presses the stencil 61 against a thermal head or heating means 30. The platen roller 92 and rollers 93*a* and 93*b* are rotated to intermittently convey the stencil 61 to the downstream side. A platen motor 26 drives the platen roller 92. A number of fine heating elements are arranged in an array on the thermal head 30 in the main scanning direction. The heating elements selectively generate heat in accordance with the digital image data output from the AD converter. As a result, a thermosensitive resin film included in the stencil 61 and contacting the heating elements generating heat is perforated, or cut, by the heat. In this manner, the image data is written in the stencil 61 in the form of a perforation pattern.

A pair of master feed rollers 94*a* and 94*b* convey the leading edge of the perforated part of the stencil 60, i.e., a master 61*a* toward the circumference of the print drum 101. A guide, not shown, steers the leading edge of the master 61*a* downward and causes it to hang down toward a master damper 102, which is mounted on the print drum 101 and held in an open position as indicated by a phantom line in FIG. 1. At this time, the used master 61*b* has already been removed from the print drum 101.

The master damper 102 clamps the leading edge of the master 61*a* at a preselected timing. The print drum 101 then rotates clockwise, as indicated by an arrow A in FIG. 1, so that the master 61*a* is sequentially wrapped around the print drum 101. A cutter 95 cuts the stencil 61 at a preselected length to thereby separate the master 61*a* from the stencil 60. This is the end of the master making and feeding step.

A printing step begins after the master making and feeding step. Specifically, the sheet feeder 110 includes a sheet tray 51 loaded with a stack of sheets 62. A pickup roller 111 and a pair of separator rollers 112*a* and 112*b* pay out the top sheet 62 from the sheet tray 51 toward a pair of registration rollers 113*a* and 113*b* in a direction indicated by an arrow Y4 in FIG. 1. The registration rollers 113*a* and 113*b* drive the sheet 62 toward the pressing section 120 at a preselected timing synchronous to the rotation of the print drum 101. The pressing section 120 includes a press roller 103 usually spaced from the print drum 101. When the leading edge of the sheet 62 arrives at a position between the print drum 101 and the press roller 103, the press roller 103 is moved upward to press the sheet 62 against the master 61*a* wrapped around the print drum 101. As a result, ink is transferred from the porous portion, not shown, of the print drum 101 to the sheet 62 via the perforation pattern, not shown, of the master 61*a*, printing an image on the sheet 62.

The print drum 101 has thereinside an ink feed tube 104 that plays the role of the shaft of the drum 101 at the same time. Ink drops from the ink feed tube 104 into an ink well 107 formed between an ink roller 105 and a doctor roller 106. The ink roller 105 contacts the inner circumference of the print drum 101 and rotates in the same direction as and in synchronism with the print drum 101, feeding the ink to the inner circumference of the drum 101. The ink is a W/O type emulsion ink.

A peeler 114 peels off the sheet 62 on which the image is printed from the print drum 101. A belt 117 is passed over an inlet roller 115 and an outlet roller 116 and conveys the sheet 62 to the sheet discharging section 130, as indicated by an arrow Y5 in FIG. 1. At this instant, a suction fan 118 surely retains the sheet 62 on the belt 117 by suction. Finally, the sheet 62 is driven out to a print tray 52 as a trial printing.

Subsequently, the operator inputs a desired number of prints on numeral keys, not shown, and then presses a print start key not shown. In response, the procedure described above is repeated in the same manner a number of times corresponding to the number of desired prints.

Figure 2:
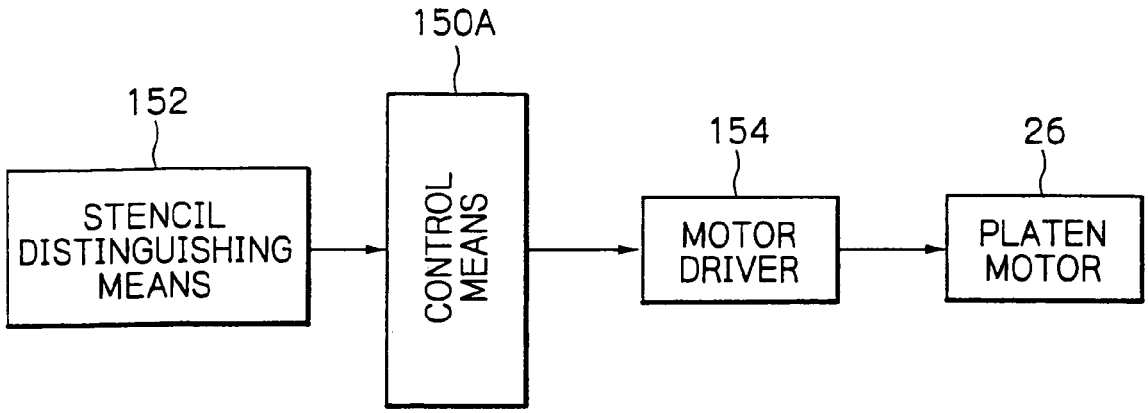
FIG. 2 is a schematic block diagram showing a first embodiment of the control system for the stencil printer in accordance with the present invention.

FIG. 2 shows a first embodiment of a control system for the stencil printer in accordance with the present invention. As shown, the control system is implemented as control means 150A that is a microcomputer including a CPU (Central Processing Unit), a ROM (Read Only Memory), a RAM (Random Access Memory), and I/O (Input/Output) interface. Further, the control means 150A serves as adjusting means for selecting an adequate master making condition in accordance with the kind of the stencil 61. Stencil distinguishing means 152 identifies the kind of the stencil 61 when the stencil 61 is set in the master making device 90. The control means 150A controls the rotation of the platen motor 26 via a motor driver 154 on the basis of the kind of the stencil 61 identified by the stencil distinguishing means 61. In the illustrative embodiment, the platen motor 26 is implemented by a pulse motor. It is to be noted that a second to a thirteenth embodiment to be described later also include the stencil distinguishing means 152 each.

Figure 3:
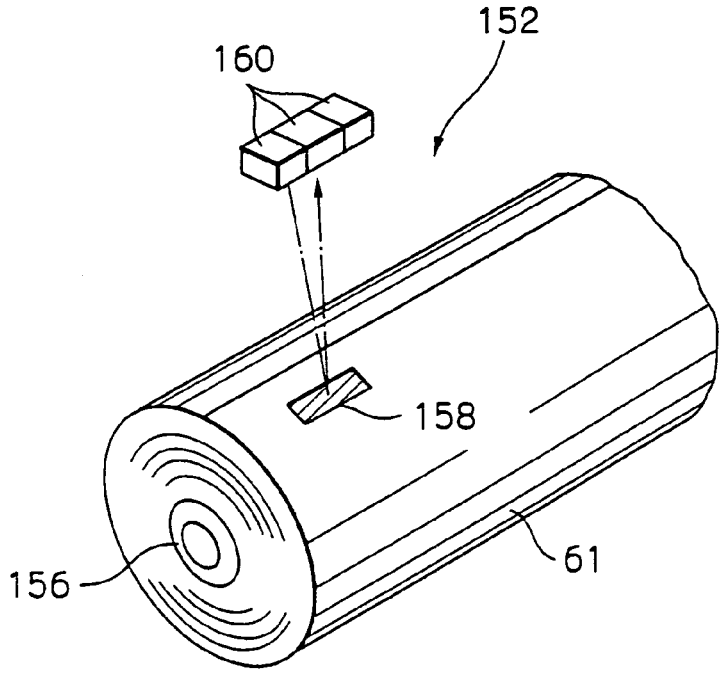
FIG. 3 is an isometric view showing a specific configuration of stencil distinguishing means included in the control system of FIG. 2.

As shown in FIG. 3, the stencil distinguishing means 152 is made up of a label 158 adhered to the leading edge portion of the stencil 61 implemented as a roll and sensing means for reading the label 158. For the sensing means, use may be made of a plurality of reflection type photosensors 160. In FIG. 3, the stencil 61 is rolled on a core 156.

Figure 4:
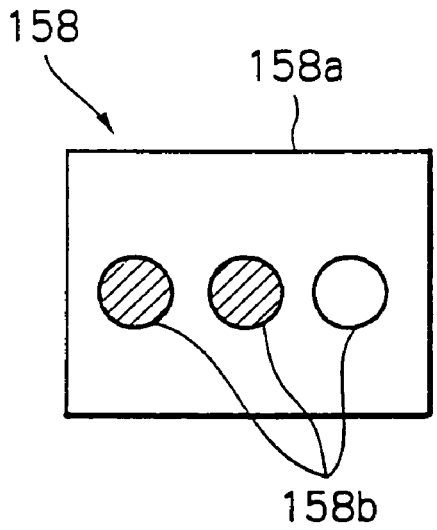
FIG. 4 is a view showing a label forming part of the stencil distinguishing means of FIG. 3.

As shown in FIG. 4, in the illustrative embodiment, the label 158 is made up of a white sheet 158*a* and three circular marks 158*b* formed on the front surface of the white sheet 158*a*. A seal is removably adhered to the rear surface of the white sheet 158*a*. One or more of the three circular marks 158*b* are painted black in order to show the kind of the master 61. If desired, the circular marks 158*b* may be replaced with symbols or a code. Of course, the label 158 may be adhered to the core 156 or one side of the stencil 61 rolled on the core 156.

A relation between the kind of the master 61 and the feed speed of the platen motor 26, which causes the platen motor 26 to rotate at a speed adequate for the kind of the master 61, is experimentally determined beforehand with the actual master making device 90. The rotation speed of the platen roller 92 determines a master conveying speed. The ROM mentioned earlier stores data representative of the above relation, i.e., a master making condition. The control means 150A reads adequate one of platen motor feed speeds out of the ROM in accordance with the kind of the stencil 61 identified by the stencil distinguishing means 152 and sets the adequate speed. This successfully maintains a distance over which the stencil 61 is conveyed constant without regard to the kind of the stencil 61, thereby insuring the reproducibility of the size of an image.

Figure 5:
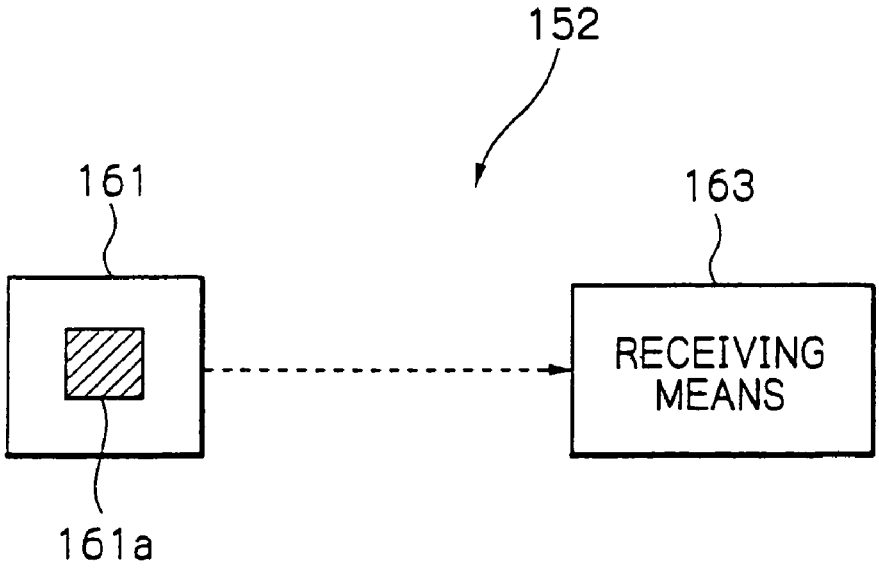
FIG. 5 shows another specific configuration of the stencil distinguishing means.

FIG. 5 shows another specific configuration of the stencil distinguishing means 152. As shown, an IC (Integrated Circuit) tag or transmitting means 161 is provided on the stencil 156 inclusive of the core 156. Receiving means 163 is mounted on the apparatus body. An IC chip 161*a* included in the IC tag 161 stores the kind of the master 61 and can transmit it to the receiving means 163. If desired, a resonance tag, for example, may be provided on the stencil 61 although not shown specifically.

Alternatively, a chip or similar miniature capacitor may be provided on the stencil 61 or the core 156 as means to be sensed, in which case a capacity sensor will be mounted on the apparatus body as sensing means. The capacity sensor determines the kind of the stencil 61 in terms of capacity. This capacity scheme may be replaced with a resistance scheme. Specifically, a chip or similar miniature resistor may be provided on the stencil 61 or the core 156 as means to be sensed, in which case a resistor sensor will be mounted on the apparatus body as sensing means. The resistor may even be implemented as a tape or a sheet having resistance and adhered to one end or the inner periphery of the core 156.

Figure 6:
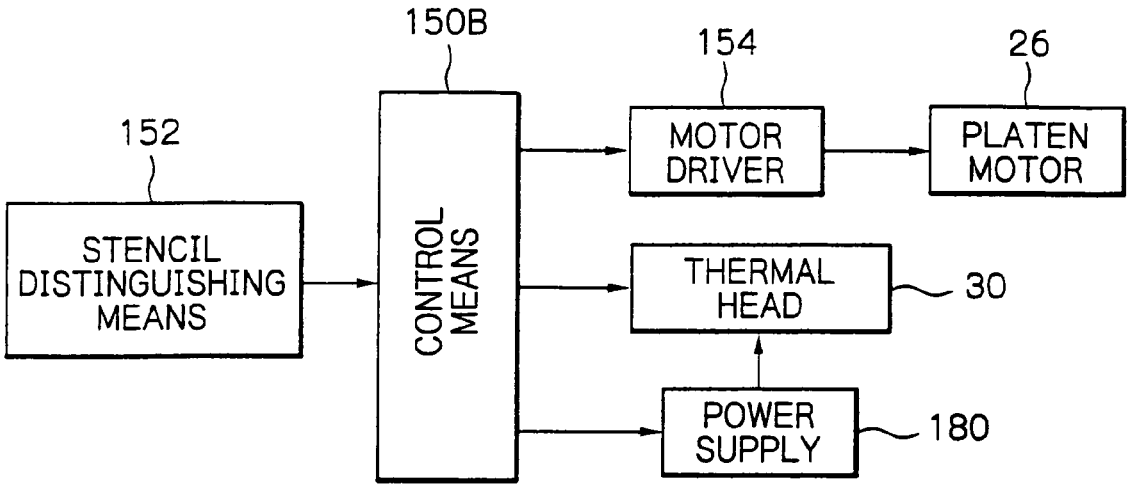
FIG. 6 is a schematic block diagram showing a second embodiment of the present invention.

FIG. 6 shows a second embodiment of the control system in accordance with the present invention. In FIG. 6, structural elements identical with the structural elements of the first embodiment are designated by identical reference numerals and will not be described specifically. This is also true with the other embodiments to be described later. The second embodiment is characterized in that it controls a master making speed, i.e., a period in which one line is written in the subscanning direction in accordance with the kind of the stencil.

Generally, assume that use is made of a stencil with low perforation sensitivity, e.g., one having great thickness for a given kind of a film. Then, it is necessary to increase energy to be applied to a thermal head. It follows that if the maximum width of pulses is fixed, then a voltage to be applied to the thermal head must be raised. This, however, shortens the service life of the thermal head. Although the pulses may be caused to overlap each other, this kind of scheme enhances heat accumulation and is not feasible for high-speed master making. More specifically, accumulated heat increases the diameter of a perforation more than expected, aggravates offset particular to a stencil printer, and degrades resistance to printing, image size reproducibility and so forth.

During perforation, the contraction stress of a thermoplastic resin film acts in a direction in which the diameter of a perforation increases. If the master making speed is low, i.e., if the writing period is long, then pressure exerted by a platen roller limits the contraction stress. This, coupled with the fact that the heat accumulation of the thermal head decreases, makes the perforation diameter smaller than a perforation diameter available at a standard master making speed. Conversely, if the master making speed is high, i.e., if the writing period is short, then a perforation is released from the pressure of the platen roller at a high speed and causes the contraction stress to sufficiently act. In addition, the heat accumulation of the thermal head is enhanced and increases the diameter of a perforation.

A relation between the kind of the master 61 and the master making speed adequate for the kind of the master 61 is experimentally determined beforehand with the actual master making device 90. A ROM included in control means 150B stores data representative of the above relation, i.e., a master making condition. For example, when the perforation sensitivity of the stencil is low, data indicative of a mater making speed as low as, e.g., 3.0 ms/line is selected. When the perforation sensitivity is standard one, data indicative of a standard master making speed, e.g., 1.5 ms/line is selected. In this manner, the master making speed is selected stepwise in accordance with the perforation sensitivity of a stencil.

As shown in FIG. 6, the control means 150B is connected to the stencil distinguishing means 152, motor drive 154, thermal head 30, and a power supply 180. The motor driver 154 is connected to the platen motor 26. The control means 150B selects an adequate master making speed in accordance with the kind of the stencil determined by the stencil distinguishing means 152 as a master making condition. This successfully prevents heat accumulation from being enhanced or the life of the thermal head 30 from being shortened without regard to the kind or the sensitivity of the stencil, thereby maintaining the size of an image constant.

Figure 7:
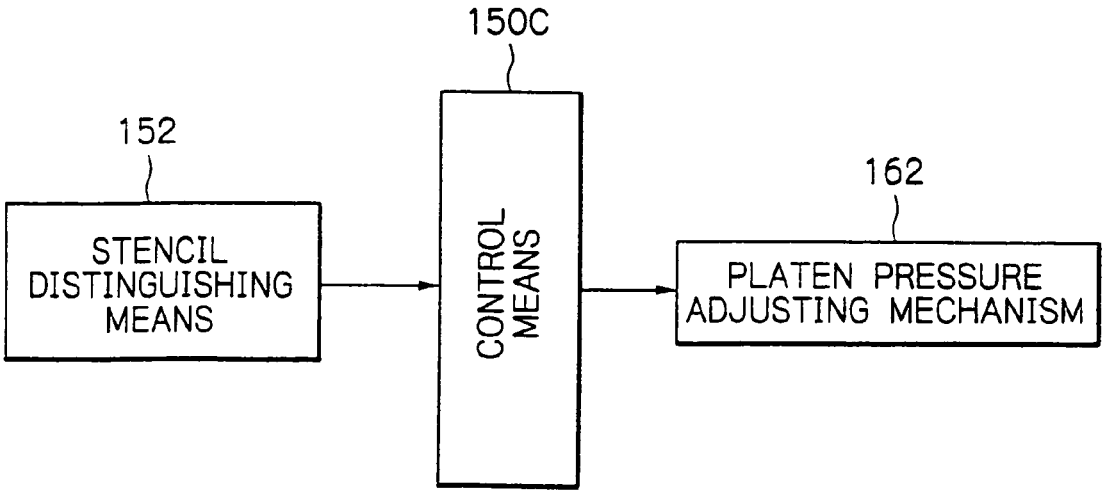
FIG. 7 is a schematic block diagram showing a third embodiment of the present invention.
Figure 8:
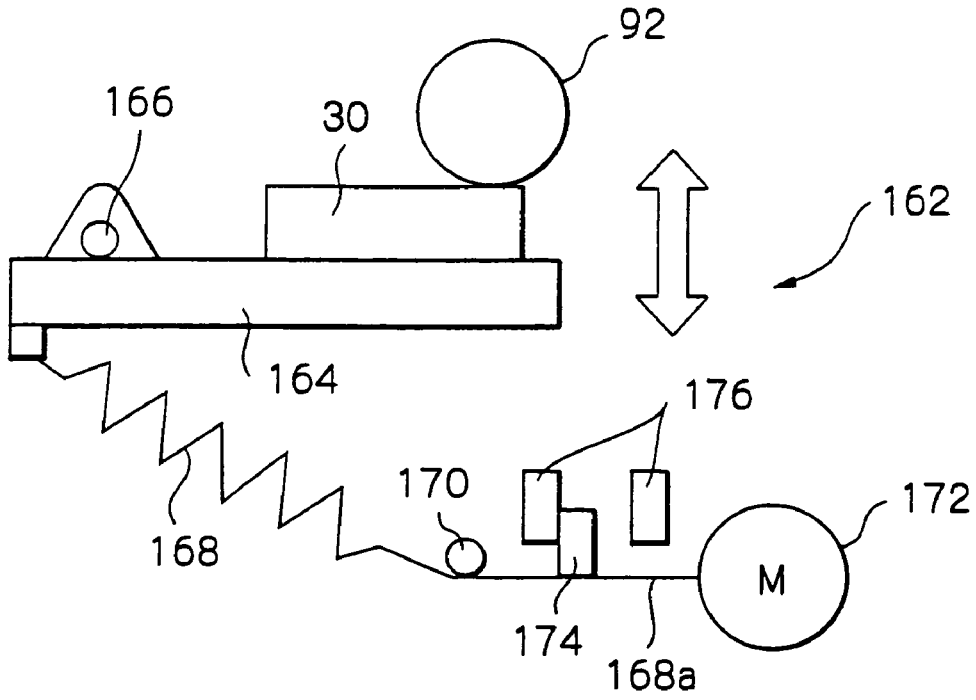
FIG. 8 is a view showing a platen pressure adjusting mechanism included in the third embodiment.

Reference will be made to FIGS. 7 and 8 for describing a third embodiment of the control system in accordance with the present invention. As shown in FIG. 7, a control means 150C controls a platen pressure adjusting mechanism 162 in accordance with the kind of the stencil identified by the stencil distinguishing means 152.

As shown in FIG. 8, the platen pressure adjusting mechanism 162 includes a stay 164 supporting the thermal head 30 at one end portion thereof. The stay 164 is angularly movable up and down about a shaft 166, as indicated by a double-headed arrow in FIG. 8. A spring 168 is anchored to the other end portion of the stay 164. A pin 170 deflects the other end portion or straight portion 168*a* of the spring 168. A DC motor 172 causes the straight portion 168*a* to move. A feeler 174 is affixed to the straight portion 168*a*. Transmission type optical sensors 176 are so positioned as to sandwich the feeler 174.

The DC motor 172 causes the spring 168 to expand or contract. The spring 168, in turn, varies pressure acting between the thermal head 30 and the thermoplastic resin film of the stencil 61, i.e., platen pressure. The control means 150C controls the rotation angle or rotation stop position of the DC motor 172 in accordance with the output of each optical sensor 176.

In the illustrative embodiment, the control means 150C interrupts the rotation of the DC motor 172 when the feeler 174 reaches the position of either one of the optical sensors 176 and interrupts its optical path. This allows the platen pressure to be adjusted in two steps. Three or more optical sensors 176 maybe used to adjust the platen pressure in three or more steps, if desired. Alternatively, the outputs of the optical sensors 176 and the rotation angle of a motor (DC motor or a stepping motor) may be used to set the platen pressure at a location other than the optical sensors 176. A cam with a particular contour, not shown, selectively cancels the contact between the heating elements of the thermal head 30 and the thermoplastic resin film of the stencil 61.

To adjust the length of the spring 168, use may be made of a reflection type sensor, e.g., a magnetic or an optical encoder responsive to a rotation angle. Further, the DC motor 172 may be replaced with a pulse motor.

A relation between the kind of the master 61 and the rotation angle or rotation stop position of the DC motor 172, which implements platen pressure adequate for the kind of the master 61, is experimentally determined beforehand with the actual master making device 90. A ROM included in the control means 150C stores data representative of the above relation, i.e., a master making condition. The control means 150C selects a rotation angle of the DC motor 172 matching with the kind of the stencil 61 determined by the stencil distinguishing means 152 and sets it as a master making condition. This prevents the platen pressure from excessively rising and increasing the mechanical stress of the thermal head 30 without regard to the kind of the stencil 61.

Figure 9:
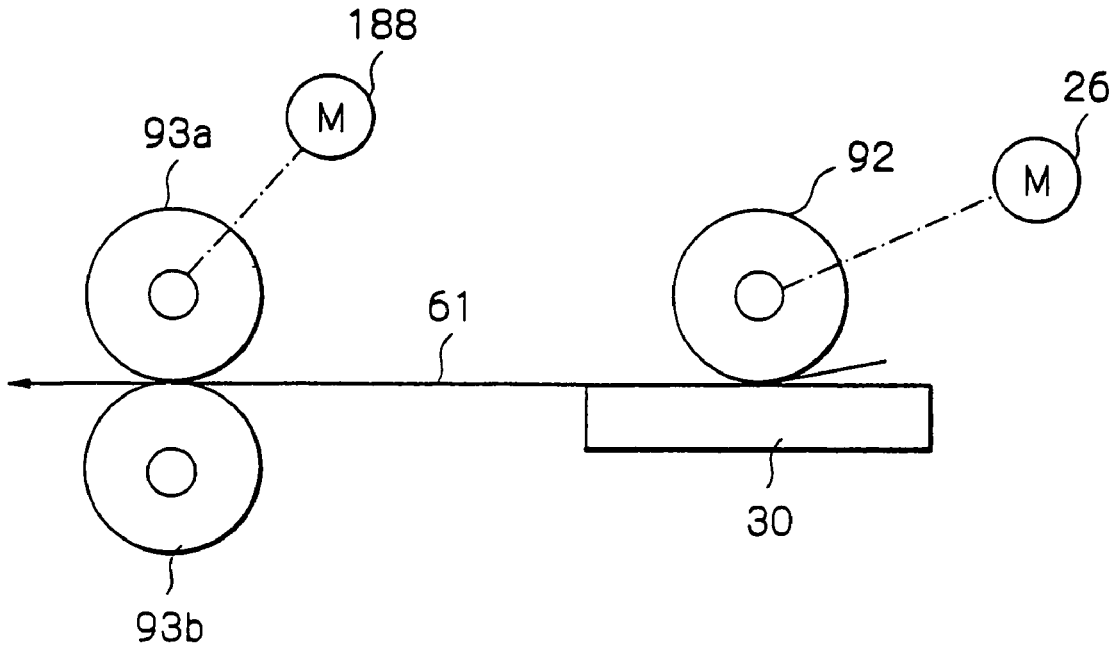
FIG. 9 is a view showing an arrangement for adjusting front tension.
Figure 10:
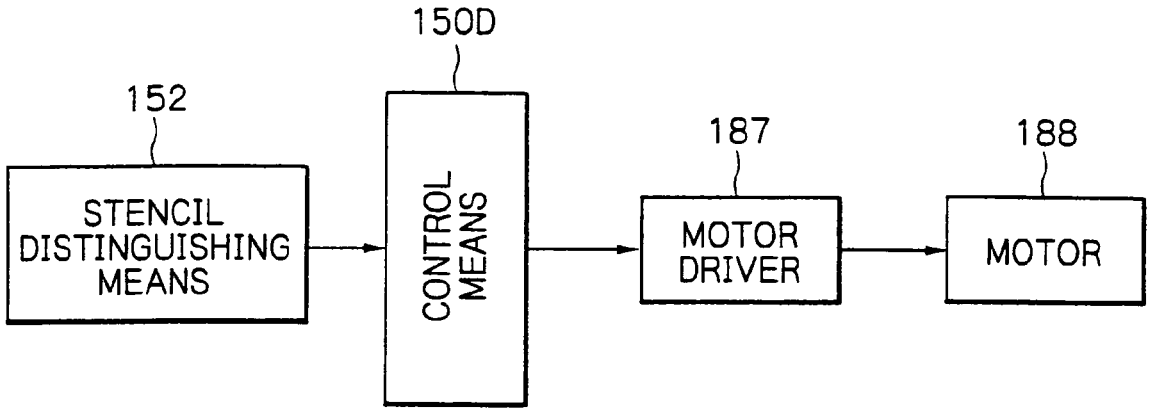
FIG. 10 is a schematic block diagram showing a fourth embodiment of the present invention.

FIGS. 9 and 10 show a fourth embodiment of the control system in accordance with the present invention. Generally, each kind of stencil has a particular tensile strength and expands or, in the worst case, tears off when conveyed under tension exceeding the tensile strength. Conversely, when the stencil is conveyed under low tension, the size of a reproduced image becomes irregular because the degree of restraint during perforation depends on the pattern. The fourth embodiment solves this problem.

As shown in FIG. 9, a motor 188 implemented by a stepping motor is drivably connected to the shaft of the feed roller 93*a*, which is positioned downstream of the platen roller 92 together with the feed roller 93*b*. The motor 188 therefore drives the feed rollers 93*a* and 93*b* independently of the platen roller 92. The rotation of the motor 188 is controllable to adjust the front tension of the stencil 61. The cutter 95 is not shown in FIG. 9.

Alternatively, the motor or drive source 26 that drives the platen roller 92 may be used to vary the pressure acting between the feed rollers 93*a* and 93*b*. Further, a gear ratio may be varied to adjust the front tension of the stencil 61.

As shown in FIG. 10, the illustrative embodiment includes control means 150D including a ROM not shown. A relation between the kind of the master 61 and the feed speed of the motor 188, which implements a front tension adequate for the kind of the master 61, is experimentally determined beforehand with the actual master making device 90. The ROM stores data representative of the above relation, i.e., a master making condition. The control means 150D selects an adequate feed speed of the motor 180 in accordance with the kind of the stencil 61 identified by the stencil distinguishing means 152 as a master making condition. The control means 150D drives the motor 188 at the adequate feed speed via a motor driver 187. This prevents the front tension from becoming excessive or short without regard to the kind of the stencil 61, thereby insuring the reproduction of an image with a constant size.

Figure 11:
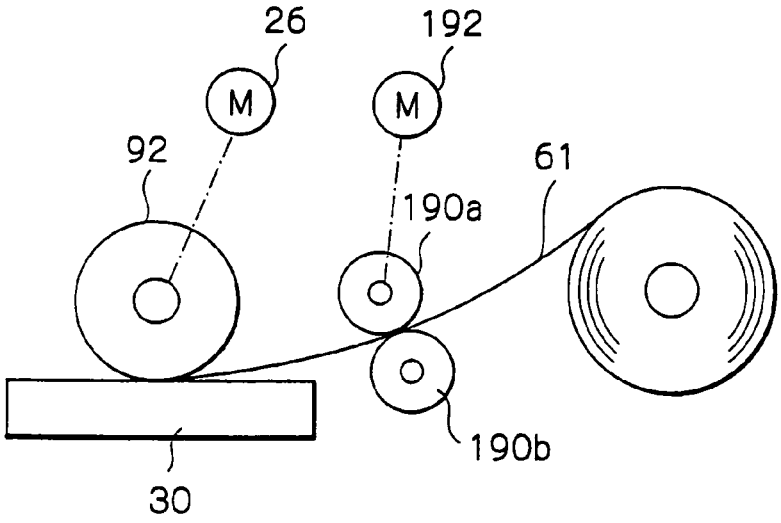
FIG. 11 is a view showing an arrangement for adjusting back tension.
Figure 12:
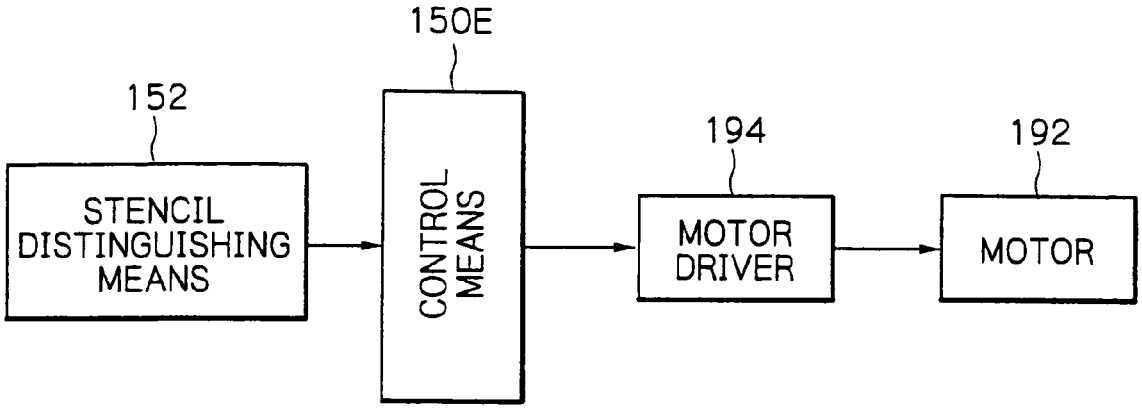
FIG. 12 is a schematic block diagram showing a fifth embodiment of the present invention.

The back tension of the stencil 6, like the front tension, effects the reproducibility of the image size. Reference will be made to FIGS. 11 and 12 for describing a fifth embodiment of the control system in accordance with the present invention, which is a solution to the above problem. As shown in FIG. 11, a motor 192 implemented by a stepping motor is drivably connected to the shaft of a feed roller 190*a*, which is positioned upstream of the platen roller 92 together with a feed roller 190*b*. The motor 192 therefore drives the feed rollers 190*a* and 190*b* independently of the platen roller 92. The rotation of the motor 192 is controllable to adjust the back tension of the stencil 61.

Alternatively, the motor or drive source 26 that drives the platen roller 92 may be used to vary the pressure acting between the feed rollers 190*a* and 190*b*. Further, a gear ratio may be varied to adjust the front tension of the stencil 61.

As shown in FIG. 12, the illustrative embodiment includes control means 150E including a ROM not shown. A relation between the kind of the stencil 61 and the feed speed of the motor 192, which implements a back tension adequate for the kind of the stencil 61, is experimentally determined beforehand with the actual master making device 90. The ROM stores data representative of the above relation, i.e., a master making condition. The control means 150E selects an adequate feed speed of the motor 192 in accordance with the kind of the stencil 61 identified by the stencil distinguishing means 152 as a master making condition. The control means 150E drives the motor 192 at the adequate feed speed via a motor driver 194. This prevents the back tension from becoming excessive or short without regard to the kind of the stencil 61, thereby insuring the reproduction of an image with a constant size.

The illustrative embodiments described so far include the motor 26 for driving the platen roller 92 each. Alternatively, the rollers 93*a* and 93*b* described in relation to the front tension may be used and controlled as a drive source for conveying the stencil 61, in which case the platen roller 92 will be driven by the above drive source.

Figure 13:
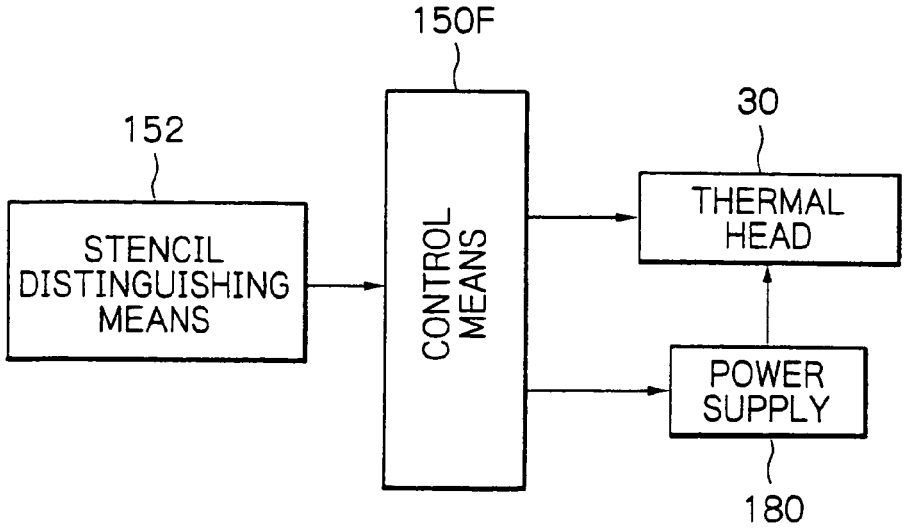
FIG. 13 is a schematic block diagram showing a sixth embodiment of the present invention.

FIG. 13 shows a sixth embodiment of the control system in accordance with the present invention. This embodiment is characterized in that energy to be applied to the thermal head 30 is controlled in accordance with the kind of the stencil 61 identified by the stencil distinguishing means 152. Specifically, as shown in FIG. 13, control means 150F controls, based on the kind of the stencil 61, energy to be applied to the thermal head 30 by controlling the pulse width for feeding current to the thermal head 30 or the power supply 180. While the illustrative embodiment controls the pulse width, it may alternatively control the output voltage of the power supply 180 or both of them.

Generally, when use is made of a stencil of the kind that can be accurately perforated, it is possible to reduce the size of perforations to be formed in the film of the stencil in a defect-free condition. This is effective to reduce, e.g., sticking when an image with a high image ratio is to be formed in the stencil, thereby enhancing accurate reproduction of an image size.

As for a relation between the perforation of the film (perforation area) and sticking (stencil contraction ratio), the sticking level rises with an increase in the perforation size of the film. In light of this, Japanese Patent Laid-Open Publication Nos. 11-115145 and 11-115148 mentioned earlier each disclose a particular scheme for controlling perforation energy in accordance with the print ratio. Adequate energy applied to the stencil extends the life of the thermal head 30 and saves energy at the same time.

A relation between the kind of the stencil 61 and the pulse width (pulse width for feeding current to each heating element of the thermal head 30) adequate for the kind of the stencil 61 is experimentally determined beforehand with the actual master making device 90. A ROM included in the control means 150F stores data representative of the above relation, i.e., a master making condition. While the pulse width may be selected in the same manner as in Laid-Open Publication No. 11-115145 or 11-115148, the illustrative embodiment selects it by taking account of the perforation ability of the stencil and the ink permeability of the porous base as well.

The control means 150F selects an adequate pulse width in accordance with the kind of the stencil 61 identified by the stencil distinguishing means 152 as a master making condition. Consequently, image quality matching with the kind of the stencil 61 is achievable.

Figure 14:
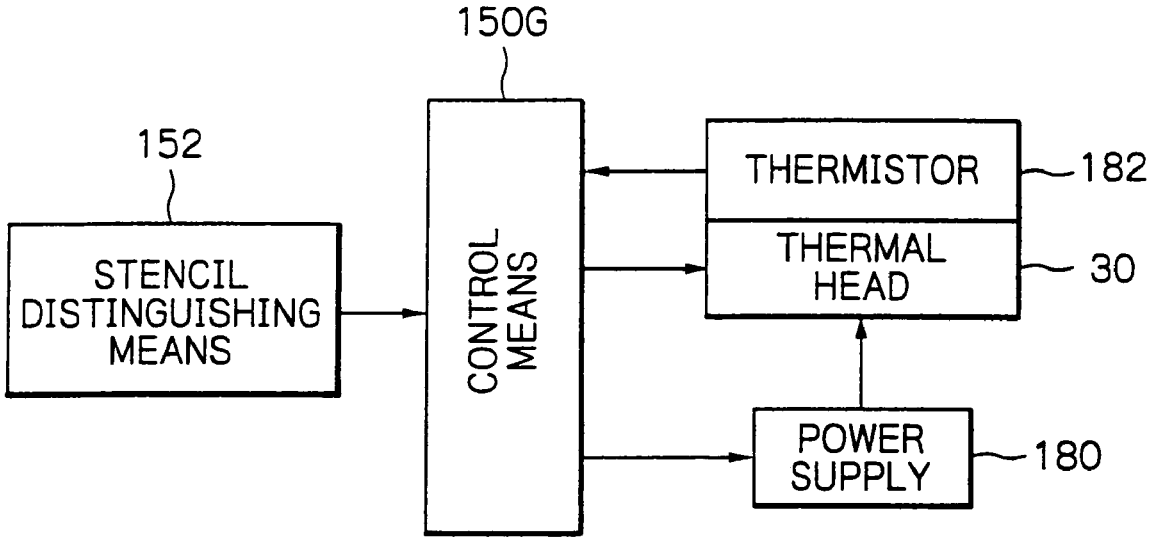
FIG. 14 is a schematic block diagram showing a seventh embodiment of the present invention.
Figure 15:
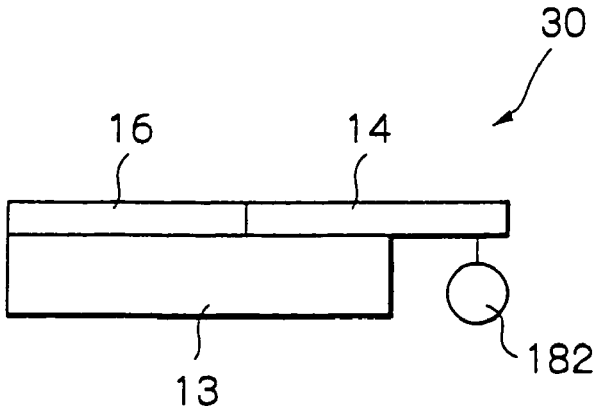
FIG. 15 is a rear view showing the location of a thermistor responsive to the temperature of a thermal head included in the seventh embodiment.

Reference will be made to FIGS. 14 and 15 for describing a seventh embodiment of the control system in accordance with the present invention. While this embodiment varies the pulse width like the sixth embodiment, it takes account of the temperature of the thermal head 30 because the temperature effects the perforation of the stencil 61. Specifically, as shown in FIG. 14, control means 150G controls energy to be applied to the thermal head 30 in accordance with the output of the stencil distinguishing means and the output of a thermistor or temperature sensing means 182.

As shown in FIG. 15, the thermal head 30 includes a heating element storing section 16, a radiator/support 13 formed of aluminum, and a substrate 14. The thermistor 182 is mounted on the substrate 14. The temperature of the thermal head 30 should preferably be sensed at a position as close to the surface of the heating portion, e.g., the surface of the center of the heating portion surrounded by electrodes. At the present stage of development, however, it is almost impossible to sense the temperature of the thermal head 30 at such a position. This is why the illustrative embodiment senses the temperature of the substrate 14. If desired, the thermistor 182 may be disposed in the radiator/support 13.

As shown in FIG. 14, the illustrative embodiment includes control means 150G including a ROM not shown. A relation between the kind of the stencil 61 and the temperature of the thermal head 30 and a pulse width adequate for them is experimentally determined beforehand with the actual master making device 90. The ROM stores data representative of such a relation as a master making condition. The control means 150 selects an adequate pulse width matching with the output of the stencil distinguishing means 152 and that of the thermistor 182 and sets it as a master making condition. The illustrative embodiment taking account of the temperature of the thermal head 30, as stated above, enhances image quality.

The illustrative embodiment may additionally take account of the kind and temperature of the ink for further promoting more practical, accurate energy control. Further, the illustrative embodiment additionally execute conventional thermal history control, common drop correction control and so forth, if desired.

Figure 16:
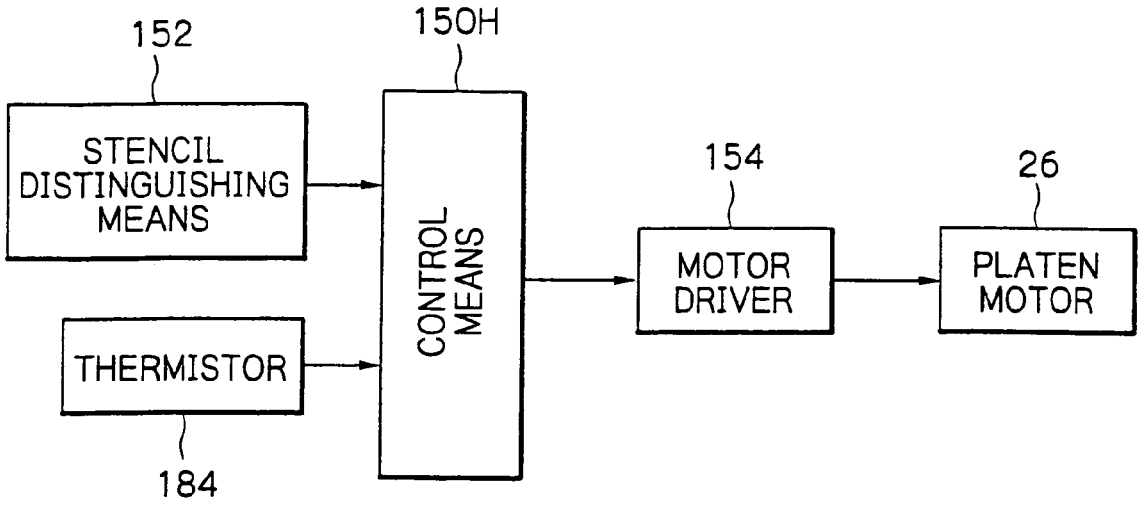
FIG. 16 is a schematic block diagram showing an eighth embodiment of the present invention.

FIG. 16 shows an eighth embodiment of the control system in accordance with the illustrative embodiment. The previous embodiments each control the rotation of the platen roller 26 in accordance with only the output of the stencil distinguishing means 152. In practice, however, such control lacks accuracy, depending on environmental conditions. For example, when ambient temperature rises, the platen roller 92 increases in diameter due to thermal expansion and therefore increases in peripheral speed, as stated earlier. The illustrative embodiment prevents control accuracy from falling due to the varying ambient conditions.

As shown in FIG. 16, a thermistor or environmental condition sensing means 184 is located at an adequate position on the printer body or the master making device 90 for sensing the temperature of the latter. Control means 150H, which is stencil distinguishing and adjusting means, stores a ROM. A relation between the kind of the master 61 and apparatus temperature and a feed speed of the platen roller 26, which implements a rotation speed of the platen roller 92 adequate for the kind of the stencil 61, is experimentally determined beforehand with the actual master making device 90. The ROM stores data representative of such a relation as a master making condition. The rotation speed of the platen roller determines a stencil conveying speed. The control means 150H selects an adequate feed speed of the platen motor 26 in accordance with the output of the stencil distinguishing means 162 and that of the thermistor 184 and sets it as a master making condition.

Figure 17:
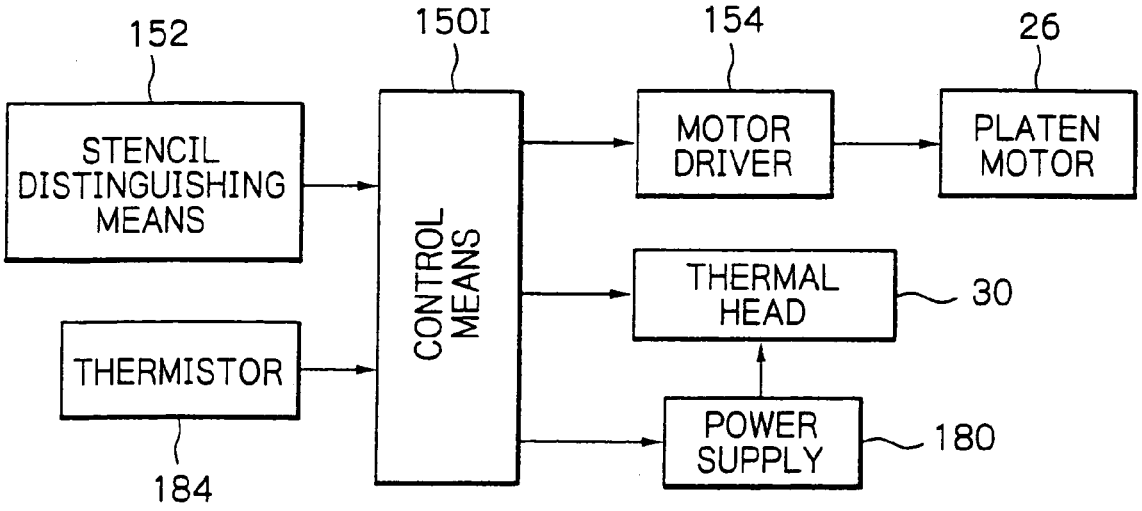
FIG. 17 is a schematic block diagram showing a ninth embodiment of the present invention.
Figure 18:
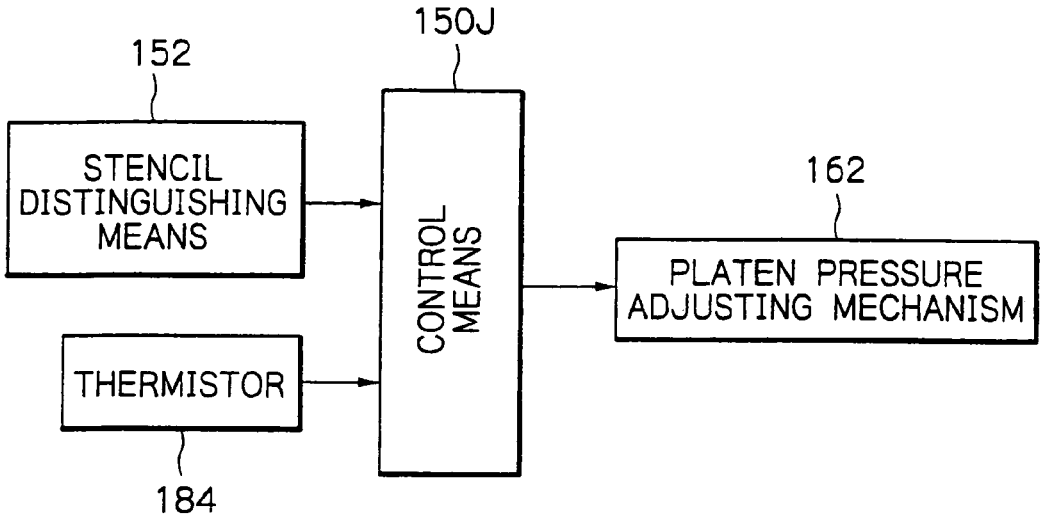
FIG. 18 is a schematic diagram showing a tenth embodiment of the present invention.
Figure 19:
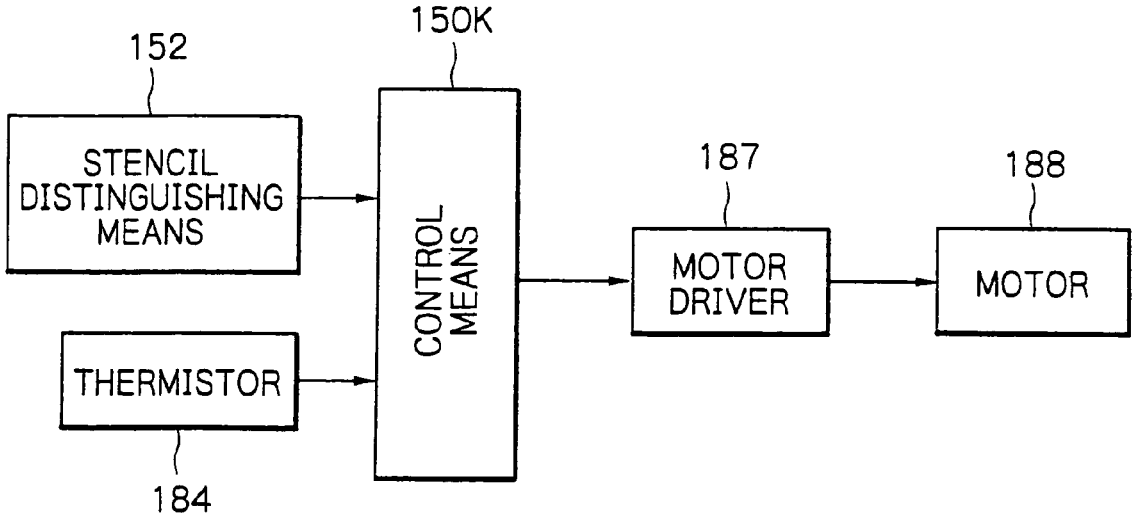
FIG. 19 is a schematic block diagram showing an eleventh embodiment of the present invention.
Figure 20:
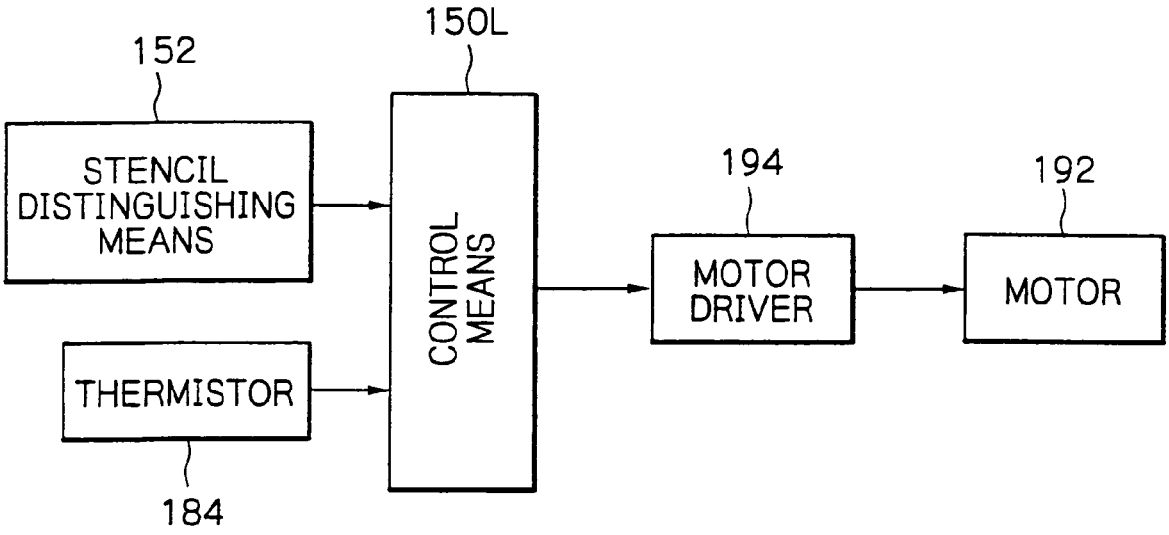
FIG. 20 is a schematic block diagram showing a twelfth embodiment of the present invention.
Figure 21:
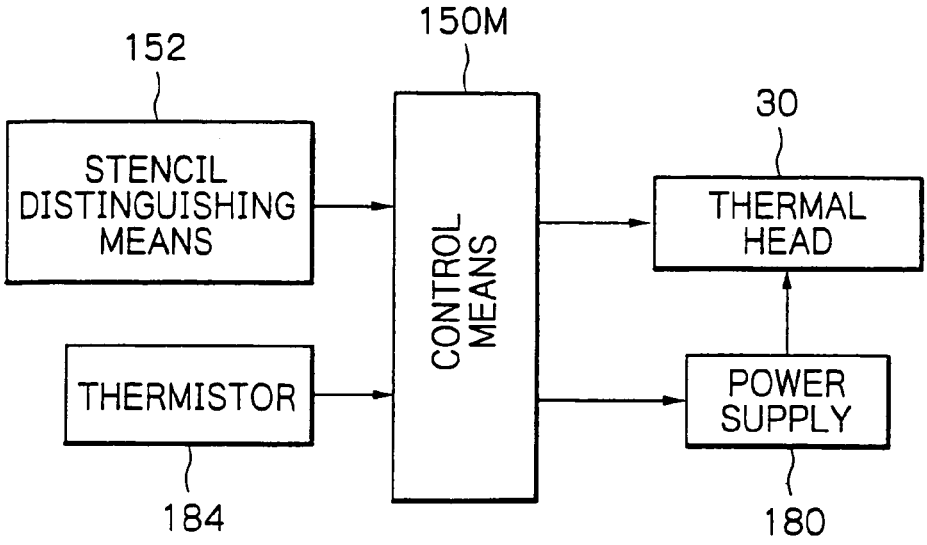
FIG. 21 is a schematic block diagram showing a thirteenth embodiment of the present invention.

FIG. 17 shows a ninth embodiment of the present invention in which control means 1501 adjusts a master making speed. FIG. 18 shows a tenth embodiment of the present invention in which control means 150J adjusts the platen pressure. FIG. 19 shows an eleventh embodiment of the present invention in which control means 150K controls the front tension of the stencil 61. FIG. 20 shows a twelfth embodiment of the present invention in which control means 150K controls the back tension of the stencil 61. Further, FIG. 21 shows a thirteenth embodiment of the present invention in which control means 150M adjusts energy to be applied to the thermal head 30.

Any one of the embodiments shown and described may sense any other environmental condition, e.g., humidity in addition to temperature.

Figure 22:
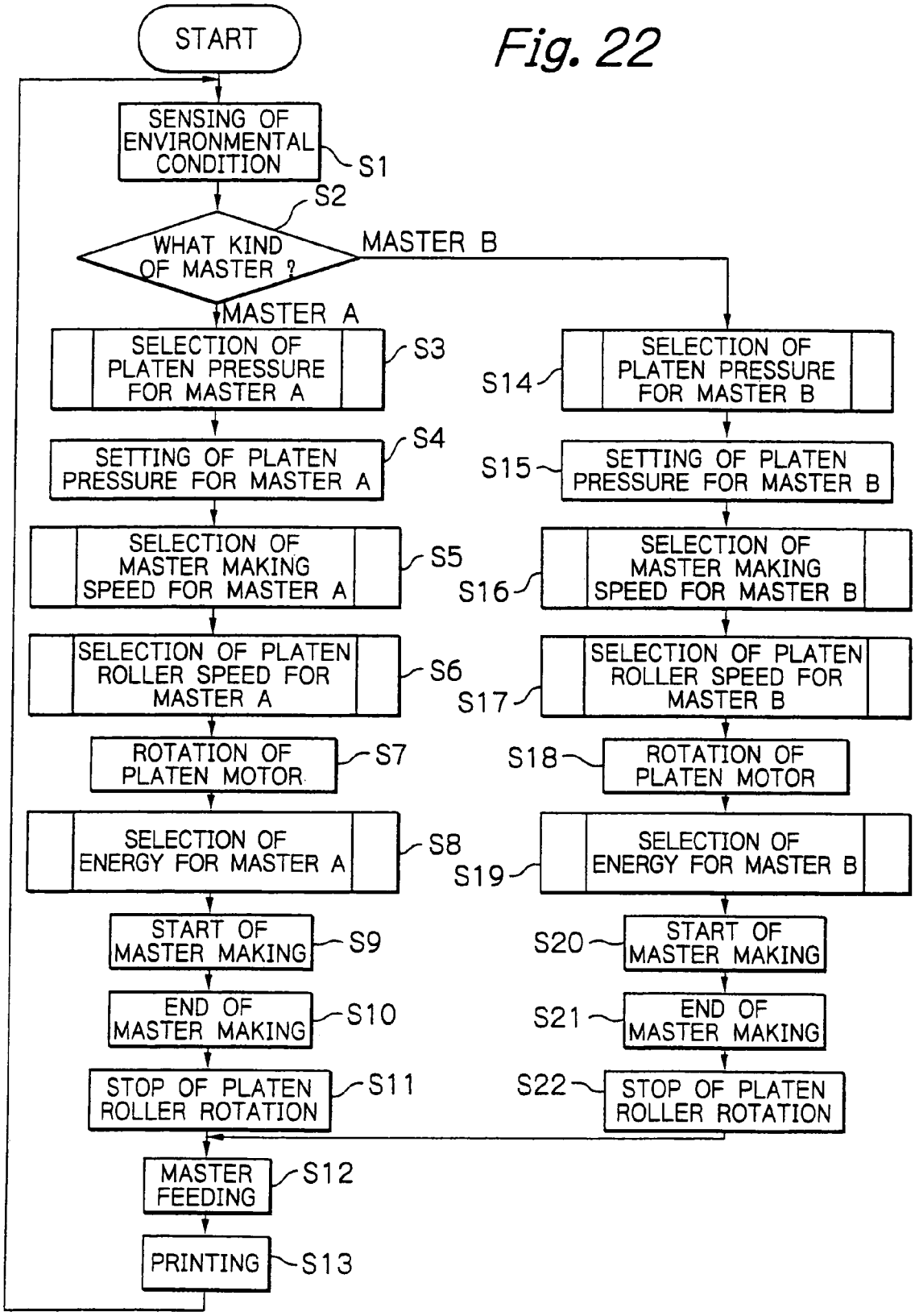
FIG. 22 is a flowchart showing a specific combined operation of the first to thirteenth embodiments.

The foregoing embodiments each control only one of the master making speed, master conveying speed, platen pressure, energy and so forth. Such different control procedures should preferably be executed in series so as to further promote accurate control, as will be described specifically with reference to FIG. 22. As shown, an environmental condition is determined on the basis of the output of the thermistor 184 or similar environment condition sensing means (step S1). Next, the kind of the stencil is identified in accordance with the output of the stencil distinguishing means 152 (step S2). If the stencil is determined to be a stencil A, then the control means 150 selects a rotation angle of the DC motor 172 matching with the stencil A out of the ROM (step S3) and sets the associated platen pressure as one of master making conditions (step S4).

After the step S4, a master making speed matching with the stencil A is selected (step S5), and then a feed speed of the platen motor S26 matching with the stencil A is selected (step S6). Subsequently, the platen roller 26 is driven at the feed speed selected (step S7). Thereafter, energy to be applied to the thermal head 30 and adequate for the stencil A is selected (step S8). After the step S8, a master making operation begins (step S9). After the master making operation, the platen motor 26 is caused to stop rotating (step S11). This is followed by the feed of a master to the print drum 101 (step S12) and then followed by a printing operation (step S13).

Assume that the stencil is determined to be a stencil B in the step S2. Then, the control means 150 selects the rotation angle of the DC motor 172 matching with the stencil B out of the ROM (step S14) and sets the associated platen pressure as one of master making conditions (step S15). The control means 150 then selects a master feeding speed adequate for the stencil B (step S16), selects the feed speed of the platen motor 26 adequate for the stencil B (step S17), and then drives the platen roller 26 (step S18). Thereafter, the control means 150 selects energy adequate for the stencil (step S19) and then causes a master making operation to start (step S20). On the completion of the master making operation (step S21), the control means 150 causes the platen motor 26 to stop rotating (step S22), starts feeding the master to the print drum 101 (step S12), and then executes a printing operation (step S13).

As stated above, the first to thirteenth embodiment have various unprecedented advantages, as enumerated below.

(1) Master making conditions matching with the kind of a stencil used are automatically set without resorting to expertness or troublesome work. The master making conditions set obviate manual operation even when the kind of the stencil is changed. This is desirable from the diversification and user standpoint.

(2) A distance over which the stencil is to be conveyed remains constant without regard to the kind of the stencil, so that the size of an image can be accurately reproduced.

(3) The influence of a difference in perforation sensitivity brought about by the replacement of the stencil is obviated. This insures desirable reproducibility of the size of an image while preventing the life of a thermal head from being shortened.

(4) Excessive platen pressure ascribable to the replacement of the stencil is obviated, so that the life of the thermal head is extended.

(5) The reproducibility of the size of an image is free from the influence of short or excessive front tension or that of excessive or short back tension.

(6) Image quality matching with the kind of the stencil is achievable.

(7) As soon as the stencil in the form of a master is set, it is possible to identify the kind of the stencil easily and accurately.

Other embodiments of the control system in accordance with the present invention will be described hereinafter. In the embodiments to be described, structural elements identical with the previous embodiments are designated by identical reference numerals and will not be described specifically.

Figure 23:
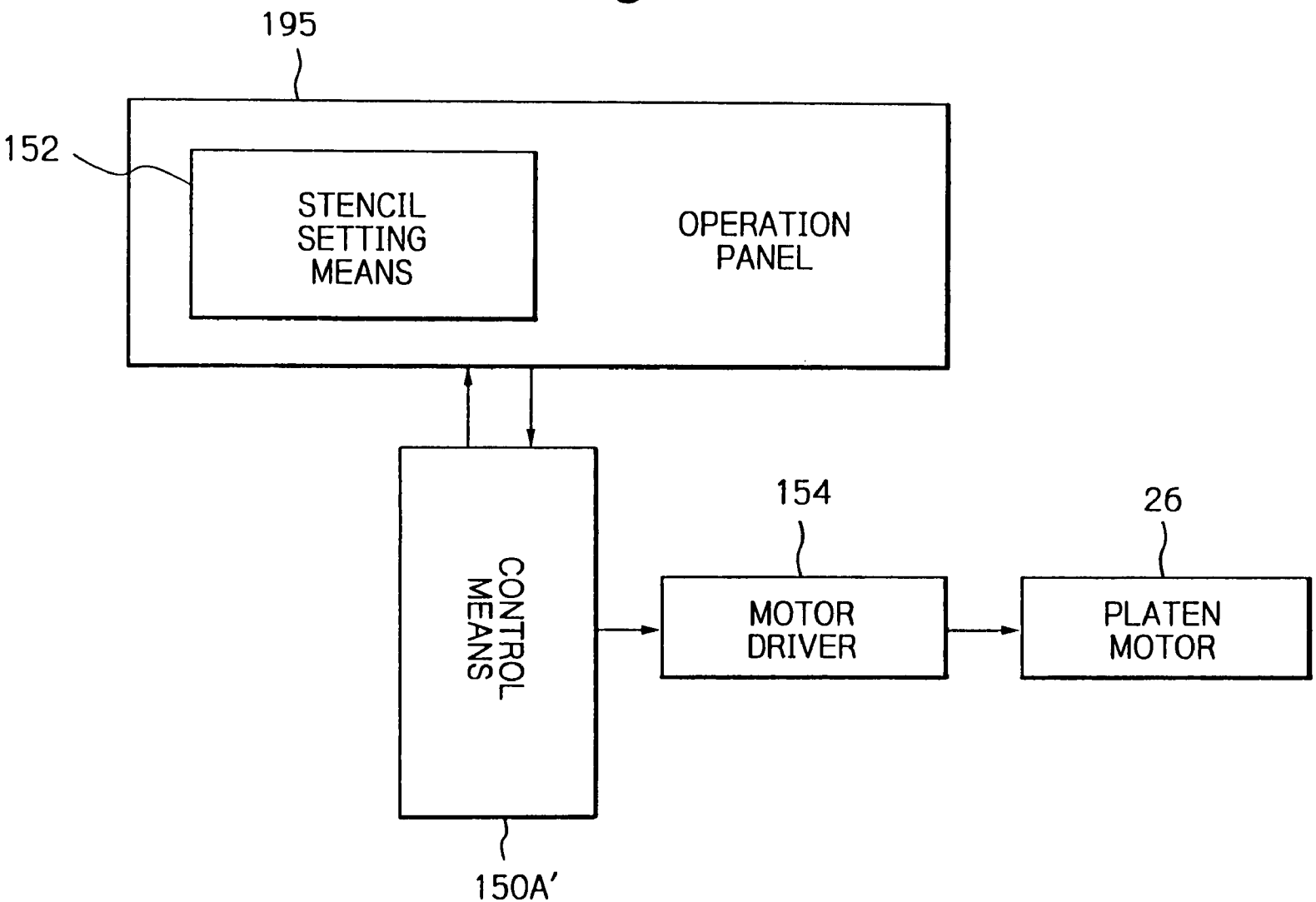
FIG. 23 is a schematic block diagram showing a fourteenth embodiment of the present invention.

Referring to FIG. 23, a fourteenth embodiment of the present invention is shown. As shown, control means 150A' is a microcomputer including a CPU, a ROM, a RAM, and I/O interface. Further, the control means 150A' serves as adjusting means for selecting adequate master making conditions in accordance with the kind of the stencil 61. The illustrative embodiment includes stencil setting means 152 for allowing the operator to manually input the kind of the stencil 61 to be used. The stencil setting means 152 is arranged on an operation panel 195. The control means 150A' controls the rotation of the platen motor or pulse motor 26 via the motor driver 154 in accordance with the kind of the stencil input on the stencil setting means 152.

The embodiments to be described after the illustrative embodiments also include the stencil setting means 152 each.

Figure 24:
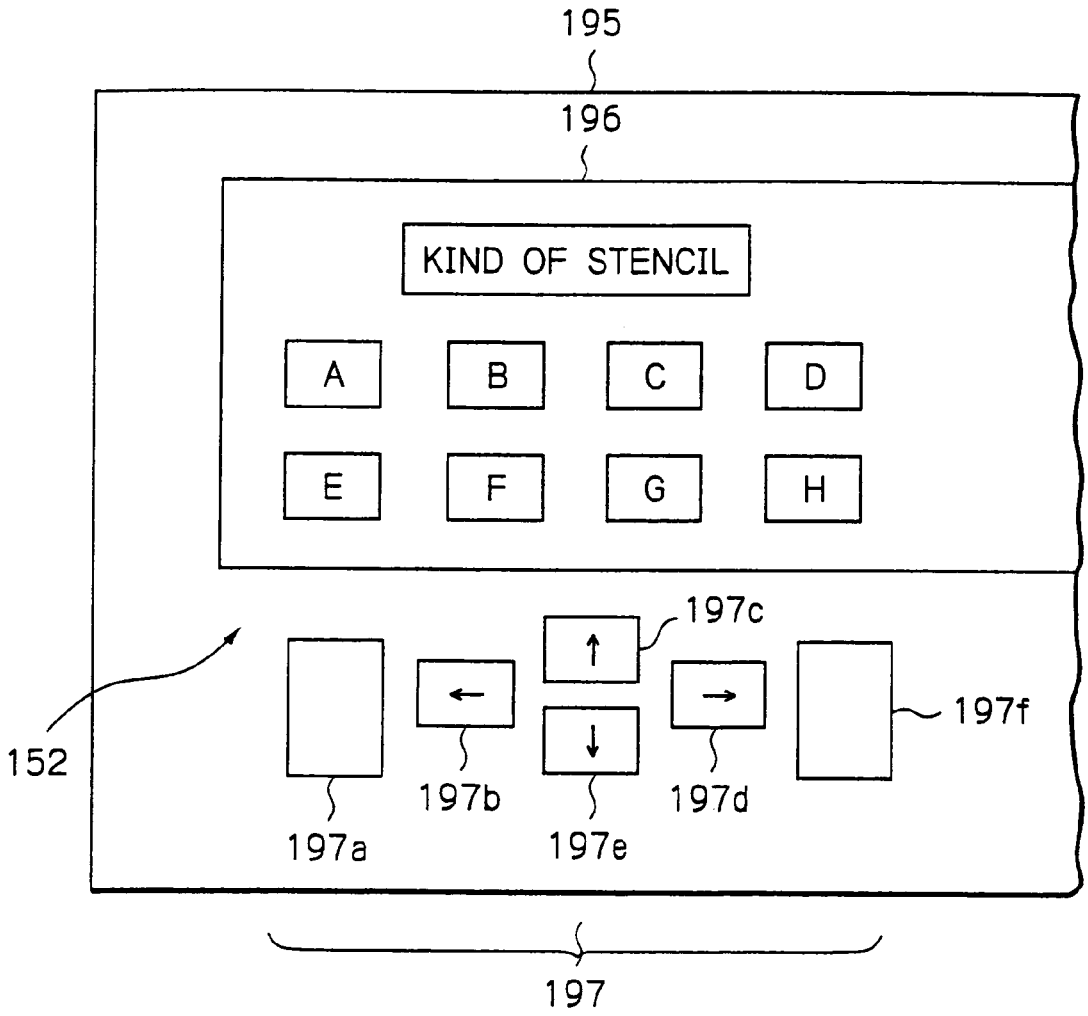
FIG. 24 is a plan view showing stencil setting means included in the fourteenth embodiment.

As shown in FIG. 24, the stencil setting means 152 includes an LCD (Liquid Crystal Display) 196 for displaying the kind of the stencil 61 and a group of keys 197*a* through 197*f* (generally 197). With the keys 197*a* through 197*f*, the operator can select one of the kinds of stencils 61 appearing on the LCD 196 and set the kind selected. In the illustrative embodiment, the operator is expected to select any one of stencils A through H, i.e., eight different kinds of stencils. The LCD 196 is used as the display of the operation panel 195 as well. More specifically, the key 197*a* is used to call the list of stencils 61 on the LCD 196. The keys 197*b* through 197*e* are cursor keys. The key 197*f* is used to set the kind of the stencil 61 selected on the LCD 196. The stencil setting means 152 may be implemented by a touch panel, if desired. Of course, the LCD 196 may be replaced with LEDs (Light Emitting Diodes) or similar light emitting devices.

The control means 150A' includes a ROM. A relation between the kind of the master 61 and the feed speed of the platen motor 26, which causes the platen roller 92 to rotate at a speed adequate for the kind of the stencil 61, is experimentally determined beforehand with the actual master making device 90. Again, the rotation speed of the platen roller 92 determines a master conveying speed. The ROM stores data representative of the above relation, i.e., a master making condition. The control means 150A' reads adequate one of platen motor feed speeds out of the ROM in accordance with the kind of the stencil 61 input on the stencil setting means 152 and sets the adequate speed. This successfully maintains a distance over which the stencil 61 is conveyed constant without regard to the kind of the stencil 61, thereby insuring the reproduction of an image with a constant size.

Figure 25:
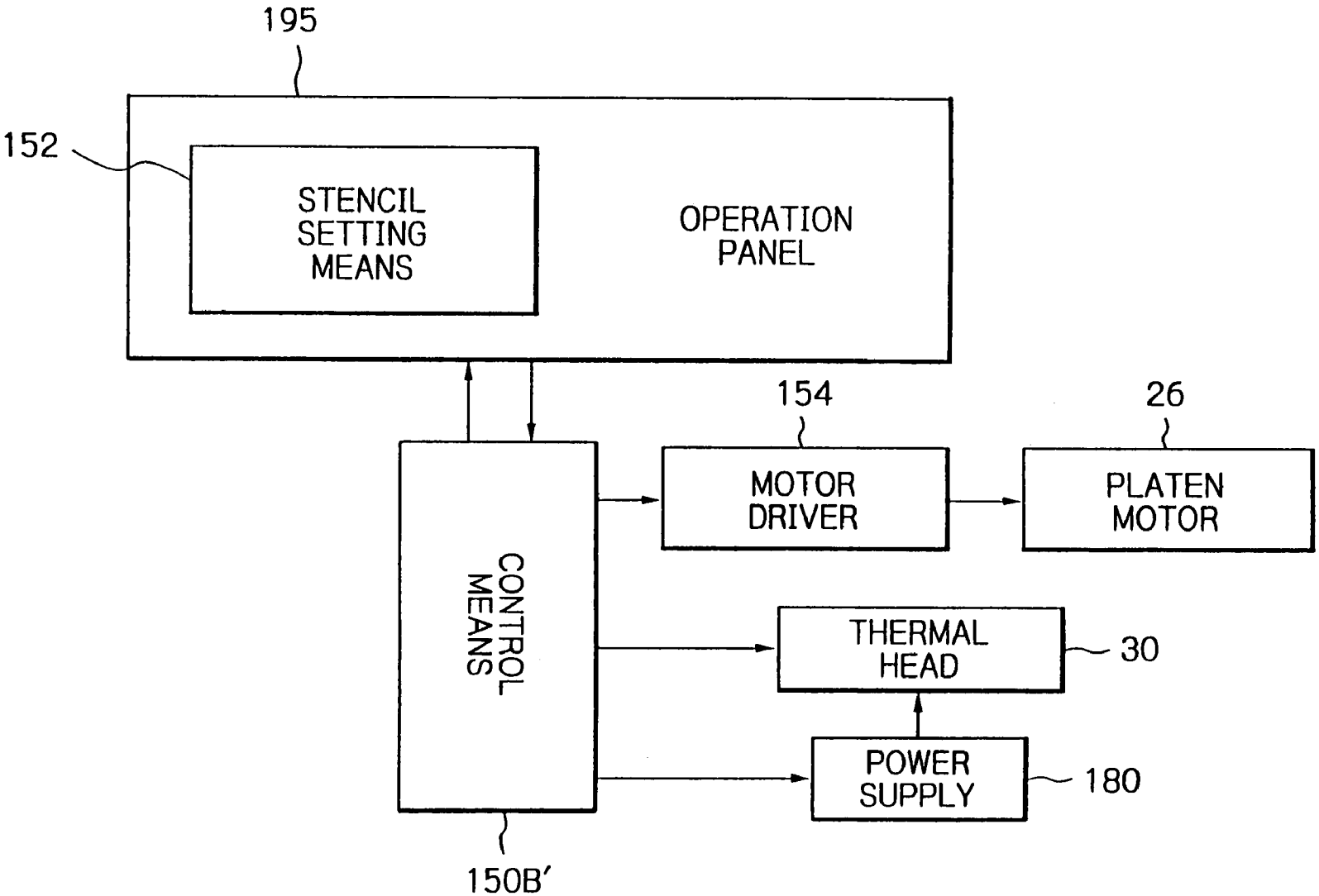
FIG. 25 is a schematic block diagram showing a fifteenth embodiment of the present invention.

FIG. 25 shows a fifteenth embodiment of the present invention. The illustrative embodiment, like the second embodiment, is characterized in that it controls a master making speed, i.e., a period in which one line is written in the subscanning direction in accordance with the kind of the stencil. As shown, the illustrative embodiment includes control means 150B' including a ROM not shown.

A relation between the kind of the master 61 and the master making speed adequate for the kind of the master 61 is experimentally determined beforehand with the actual master making device 90. The ROM of the control means 150B' stores data representative of the above relation, i.e., a master making condition. For example, when the perforation sensitivity of the stencil is low, data indicative of a mater making speed as low as, e.g., 3.0 ms/line is selected. When the perforation sensitivity is standard sensitivity, data indicative of a standard master making speed, e.g., 1.5 ms/line is selected. In this manner, the master making speed is selected stepwise in accordance with the perforation sensitivity of a stencil.

As shown in FIG. 25, control means 150B' is connected to the stencil setting means 152, motor drive 154, thermal head 30, and power supply 180. The motor driver 154 is connected to the platen motor 26. The control means 150B' selects an adequate master making speed in accordance with the kind of the stencil input on the stencil setting means 152 as a master making condition. This successfully prevents heat accumulation from being enhanced or the life of the thermal head 30 from being shortened without regard to the kind or sensitivity of the stencil, thereby maintaining the size of an image constant.

Figure 26:
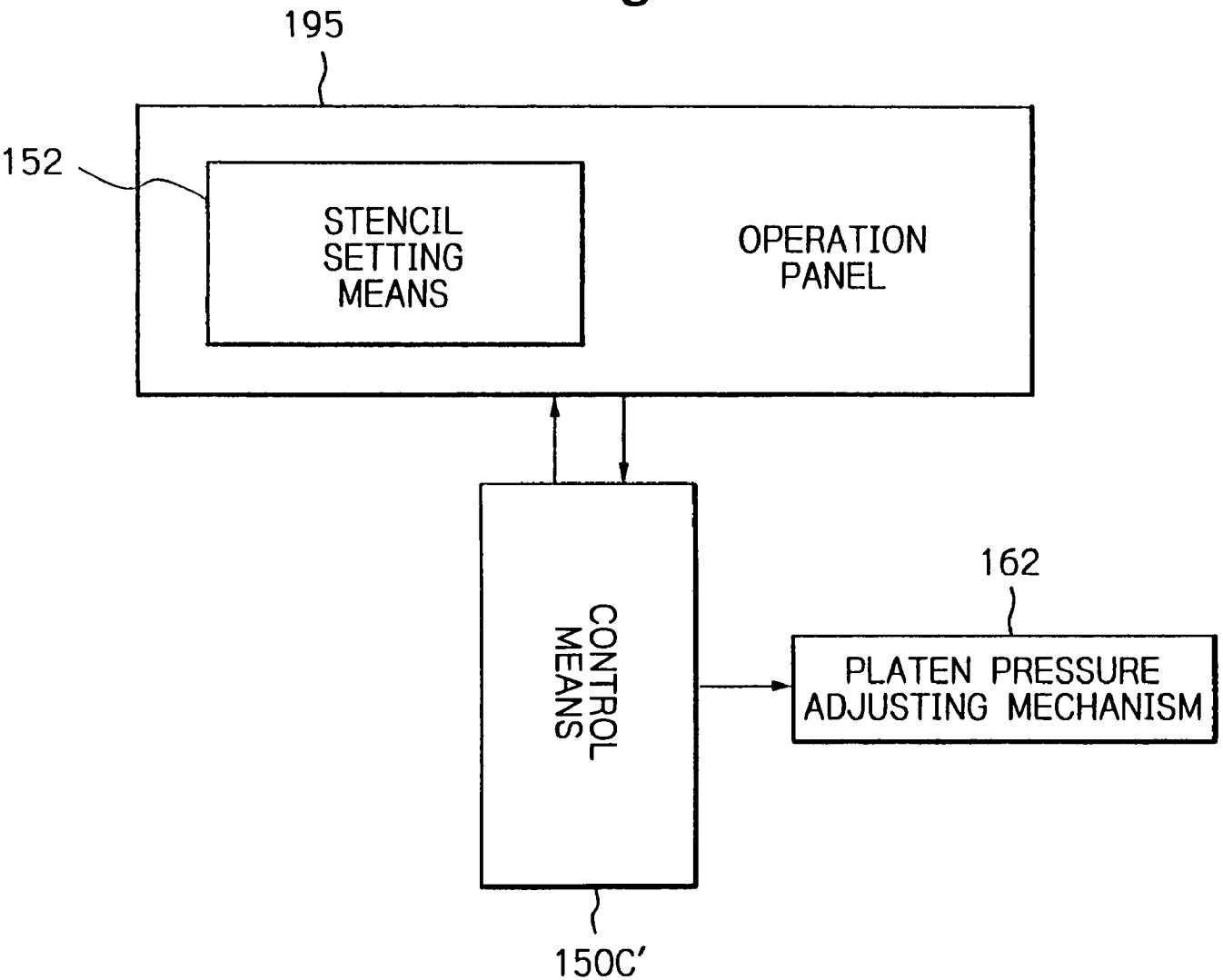
FIG. 26 is a schematic block diagram showing a sixteenth embodiment of the present invention.

Reference will be made to FIG. 26 for describing a sixteenth embodiment of the present invention. As shown, control means 150C' controls the platen pressure adjusting mechanism 162 in accordance with the kind of the stencil input on the stencil setting means 152. The platen pressure adjusting mechanism 162 has the configuration described previously with reference to FIG. 8.

In the illustrative embodiment, a relation between the kind of the master 61 and the rotation angle or rotation stop position of the DC motor 172, which implements a platen pressure adequate for the kind of the master 61, is experimentally determined beforehand with the actual master making device 90. A ROM included in the control means 150C' stores data representative of the above relation, i.e., a master making condition. The control means 150C' selects a rotation angle of the DC motor 172 matching with the kind of the master 61 input on the stencil setting means 152 and sets it as a master making condition. This prevents the platen pressure from excessively rising and increasing the mechanical stress of the thermal head 30 without regard to the kind of the stencil 61.

Figure 27:
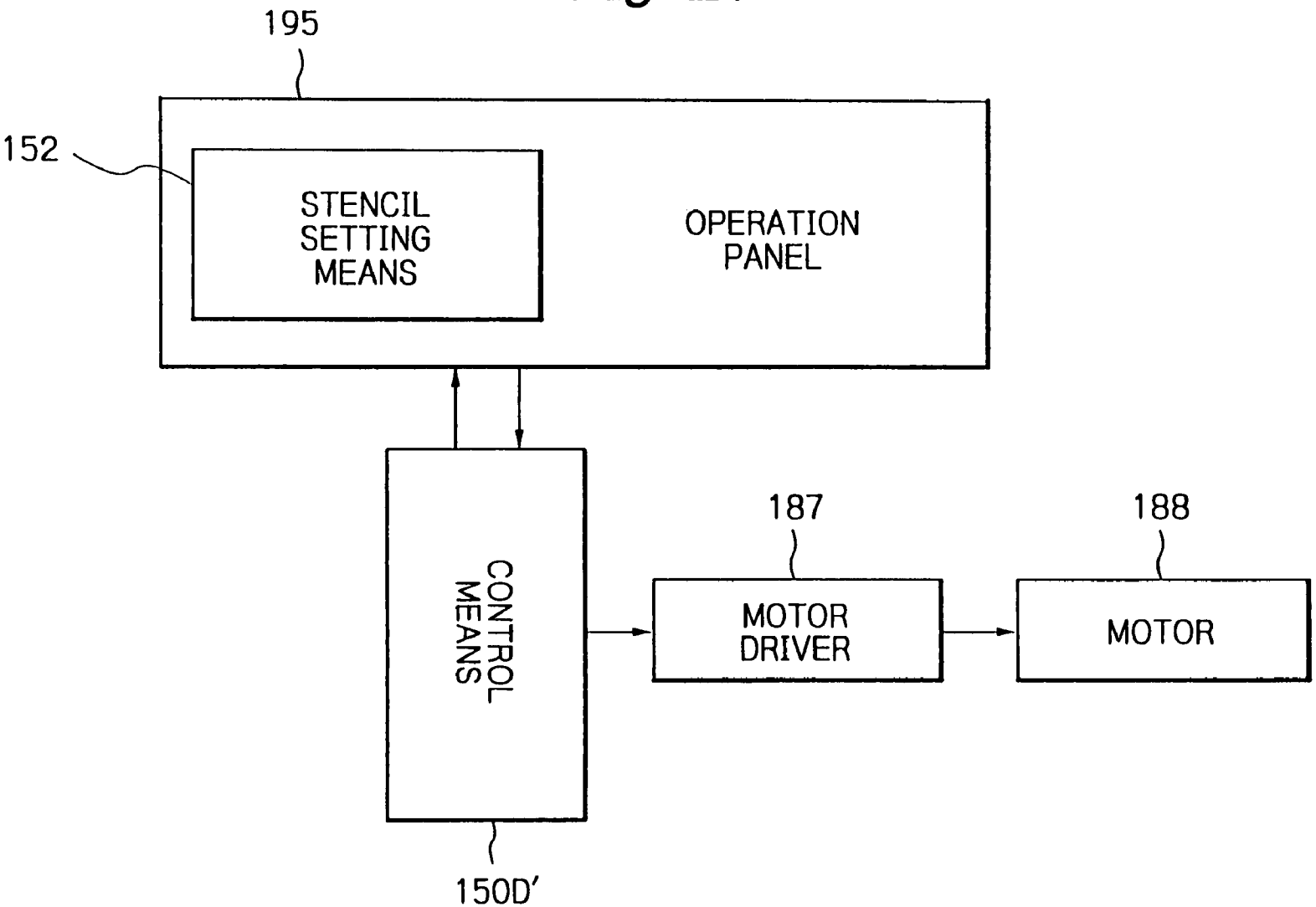
FIG. 27 is a schematic block diagram showing a seventeenth embodiment of the present invention.

FIG. 27 shows a seventeenth embodiment of the present invention similar to the fourth embodiment stated earlier. As shown, the illustrative embodiment includes control means 150D' including a ROM not shown. A relation between the kind of the master 61 and the feed speed of the motor 188, which implements a front tension adequate for the kind of the master 61, is experimentally determined beforehand with the actual master making device 90. The ROM stores data representative of the above relation, i.e., a master making condition. The control means 150D' selects an adequate feed speed of the motor 180 in accordance with the kind of the stencil 61 input on the stencil setting means 152 as a master making condition. The control means 150D' drives the motor 188 at the adequate feed speed via the motor driver 187. This prevents the front tension from becoming excessive or short without regard to the kind of the stencil 61, thereby insuring the reproduction of an image with a constant size.

Figure 28:
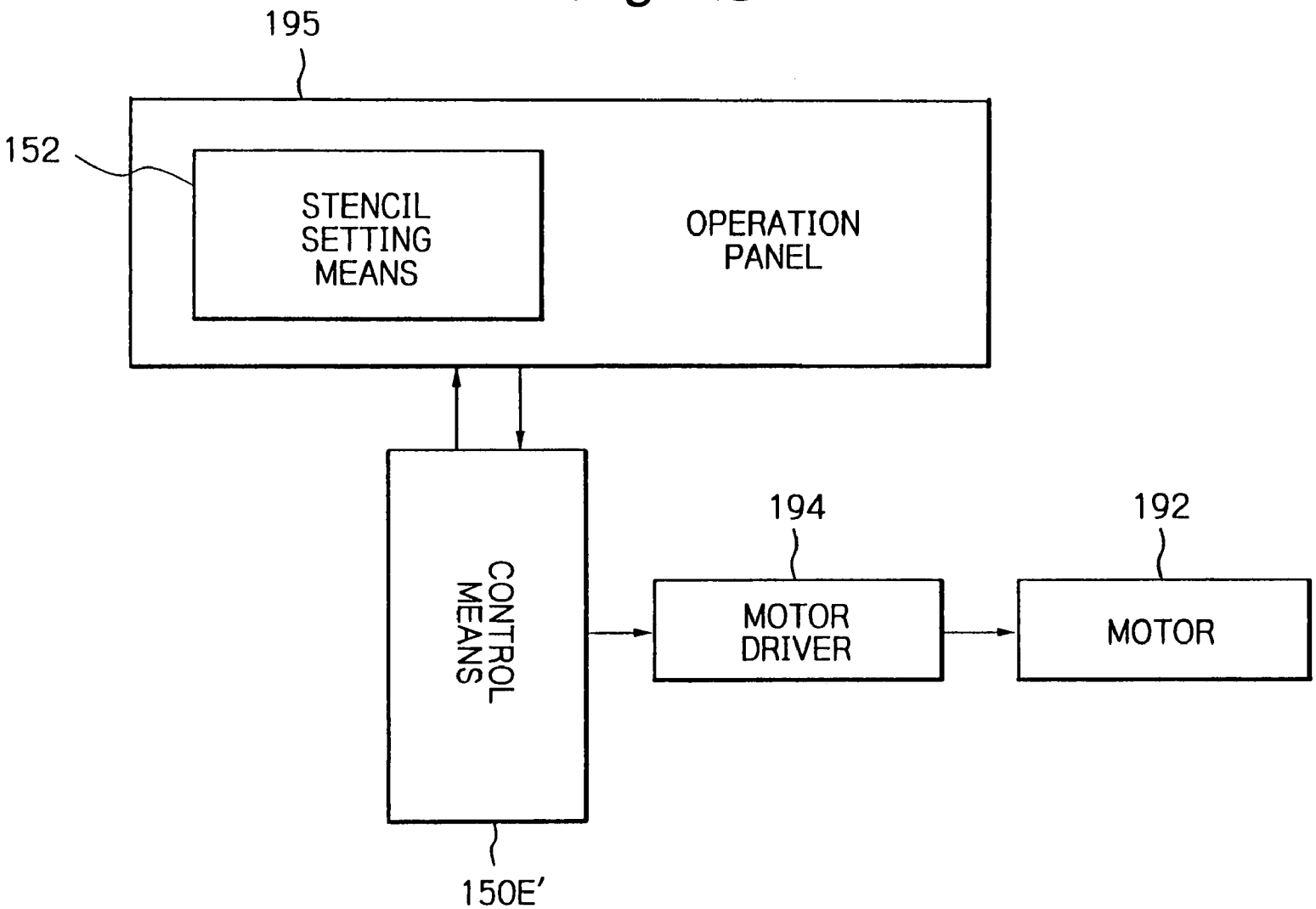
FIG. 28 is a schematic block diagram showing an eighteenth embodiment of the present invention.

The back tension of the stencil 6, like the front tension, effects the reproducibility of the image size, as stated previously. Reference will be made to FIG. 28 for describing an eighteenth embodiment of the present invention similar to the fifth embodiment. As shown, the illustrative embodiment includes control means 150E' including a ROM not shown. A relation between the kind of the stencil 61 and the feed speed of the motor 192, which implements a back tension adequate for the kind of the stencil 61, is experimentally determined beforehand with the actual master making device 90. The ROM stores data representative of the above relation, i.e., a master making condition. The control means 150E' selects an adequate feed speed of the motor 192 in accordance with the kind of the stencil 61 input on the stencil setting means 152 as a master making condition. The control means 150E' drives the motor 192 at the adequate feed speed via a motor driver 194. This prevents the back-tension from becoming excessive or short without regard to the kind of the stencil 61, thereby insuring the reproduction of an image with a constant size.

The illustrative embodiments described so above include the motor 26 for driving the platen roller 92 each. Alternatively, the rollers 93*a* and 93*b* described in relation to the front tension may be used and controlled as a drive source for conveying the stencil 61, in which case the platen roller 92 will be driven by the above drive source.

Figure 29:
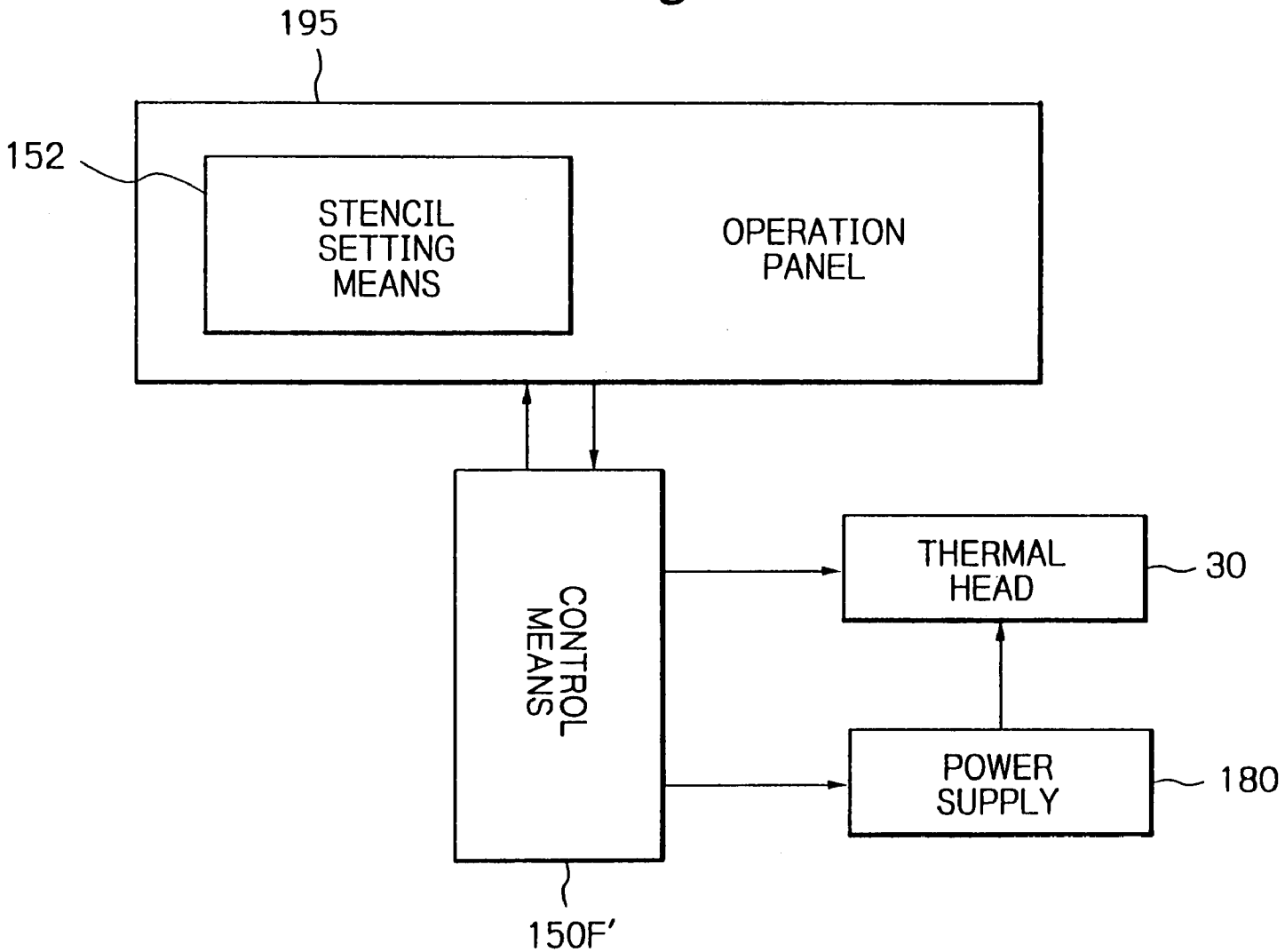
FIG. 29 is a schematic block diagram showing a nineteenth embodiment of the present invention.

FIG. 29 shows a nineteenth embodiment of the present invention similar to the sixth embodiment stated earlier. This embodiment, like the sixth embodiment, controls energy to be applied to the thermal head 30 in accordance with the kind of the stencil 61 input on the stencil setting means 152. As shown, control means 150F' controls, based on the kind of the stencil 61, energy to be applied to the thermal head 30 by controlling the pulse width for feeding current to the thermal head 30 or the power supply 180. While the illustrative embodiment controls the pulse width, it may control the output voltage of the power supply 180 or both of them.

In the illustrative embodiment, a relation between the kind of the stencil 61 and the pulse width (pulse width for feeding current to each heating element of the thermal head 30) adequate for the kind of the stencil 61 is experimentally determined beforehand with the actual master making device 90. A ROM included in the control means 150F' stores data representative of the above relation, i.e., a master making condition. Again, while the pulse width may be selected in the same manner as in Laid-Open Publication No. 11-115145 or 11-115148 mentioned earlier, the illustrative embodiment selects it by taking account of the perforation ability of the stencil and the ink permeability of the porous support as well.

The control means 150F' selects an adequate pulse width in accordance with the kind of the stencil 61 input on the stencil setting means 152 as a master making condition. Consequently, image quality matching with the kind of the stencil 61 is achievable.

Figure 30:
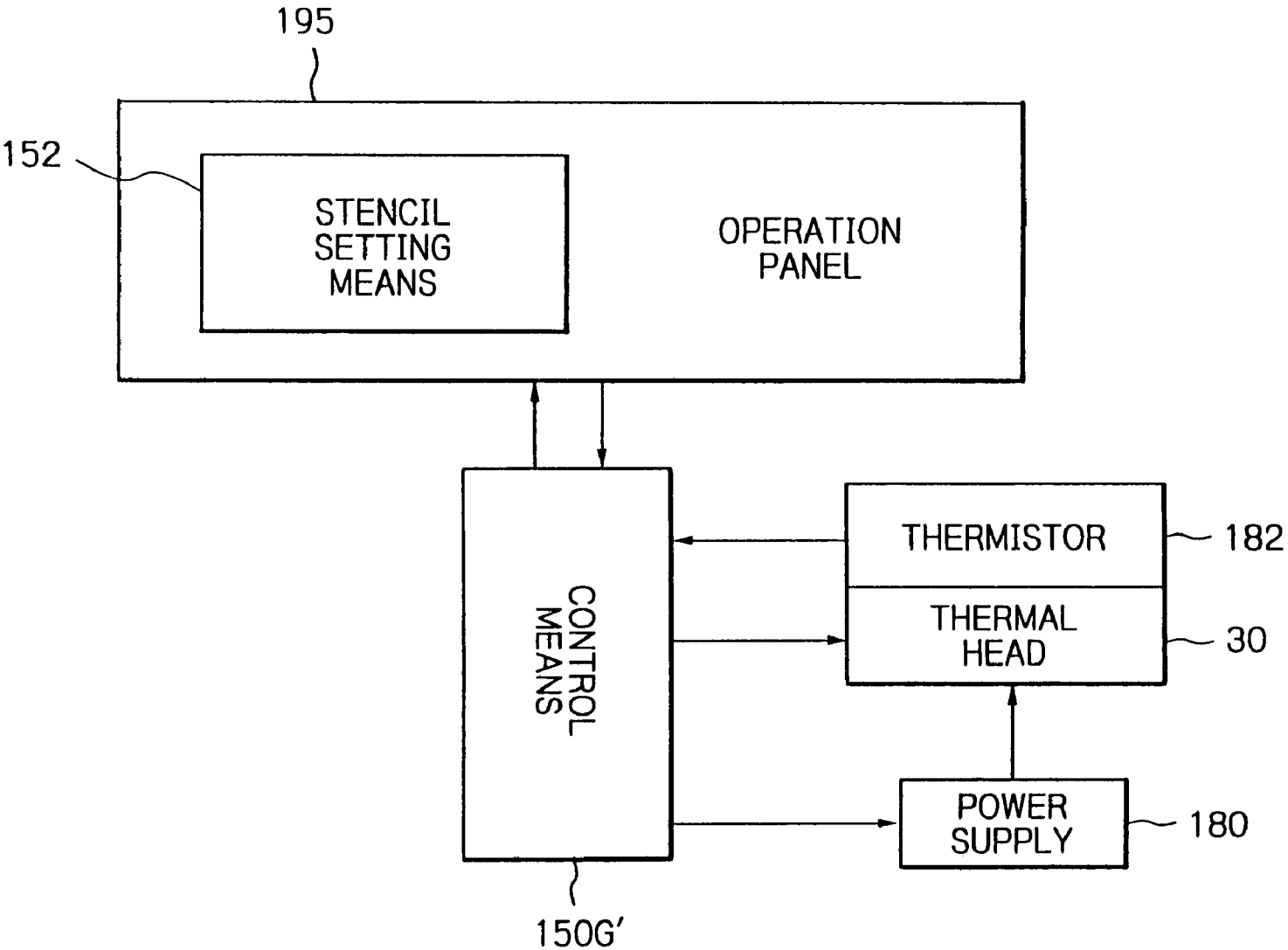
FIG. 30 is a schematic block diagram showing a twentieth embodiment of the present invention.

Reference will be made to FIG. 30 for describing a twentieth embodiment of the present invention similar to the seventh embodiment. While this embodiment varies the pulse width like the nineteenth embodiment, it takes account of the temperature of the thermal head 30 because the temperature effects the perforation of the stencil 61. As shown, illustrative embodiment includes control means 150G' including a ROM not shown. A relation between the kind of the stencil 61 and the temperature of the thermal head 30 and a pulse width adequate for them is experimentally determined beforehand with the actual master making device 90. The ROM stores data representative of such a relation as a master making condition. The control means 150G' selects an adequate pulse width matching with the output of the stencil setting means 152 and that of the thermistor 182 and sets it as a master making condition. The illustrative embodiment taking account of the temperature of the thermal head 30, as stated above, enhances image quality.

The illustrative embodiment may also additionally take account of the kind and temperature of the ink for further promoting more practical, accurate energy control. Further, the illustrative embodiment additionally executes conventional thermal history control, common drop correction control and so forth, if desired.

Figure 31:
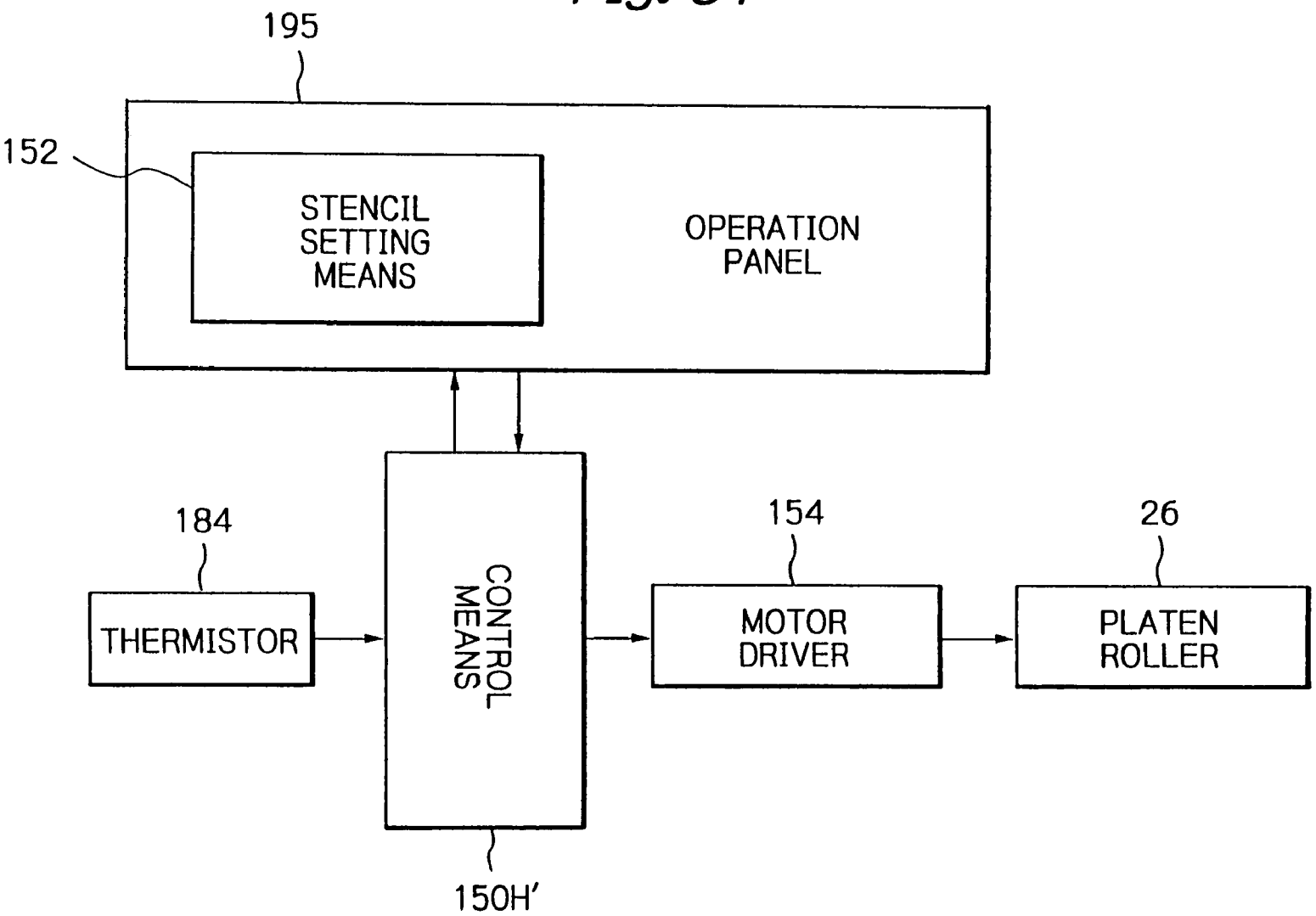
FIG. 31 is a schematic block diagram showing a twenty-first embodiment of the present invention.

FIG. 31 shows a twenty-first embodiment of the present invention similar to the eighth embodiment. The previous embodiments each control the rotation of the platen roller 26 in accordance only with the output of the stencil setting means 152. In practice, however, such control lacks accuracy, depending on environmental conditions. For example, when ambient temperature rises, the platen roller 92 increases in diameter due to thermal expansion and therefore increases in peripheral speed, as stated earlier. The illustrative embodiment prevents control accuracy from falling due to the varying ambient conditions.

As shown in FIG. 31, the thermistor or environmental condition sensing means 184 is located at an adequate position on the printer body or the master making device 90 for sensing the temperature of the latter. Control means 150H', which is stencil distinguishing and adjusting means, includes a ROM. A relation between the kind of the master 61 and device temperature and a feed speed of the platen roller 26, which implements a rotation speed of the platen roller 92 adequate for the kind of the master 61, is experimentally determined beforehand with the actual master making device 90. The ROM stores data representative of such a relation as a master making condition. The rotation speed of the platen roller determines a stencil conveying speed. The control means 150H' selects an adequate feed speed of the platen motor 26 in accordance with the kind of the stencil input on the stencil setting means 152 and the output of the thermistor 184 and sets it as a master making condition.

Figure 32:
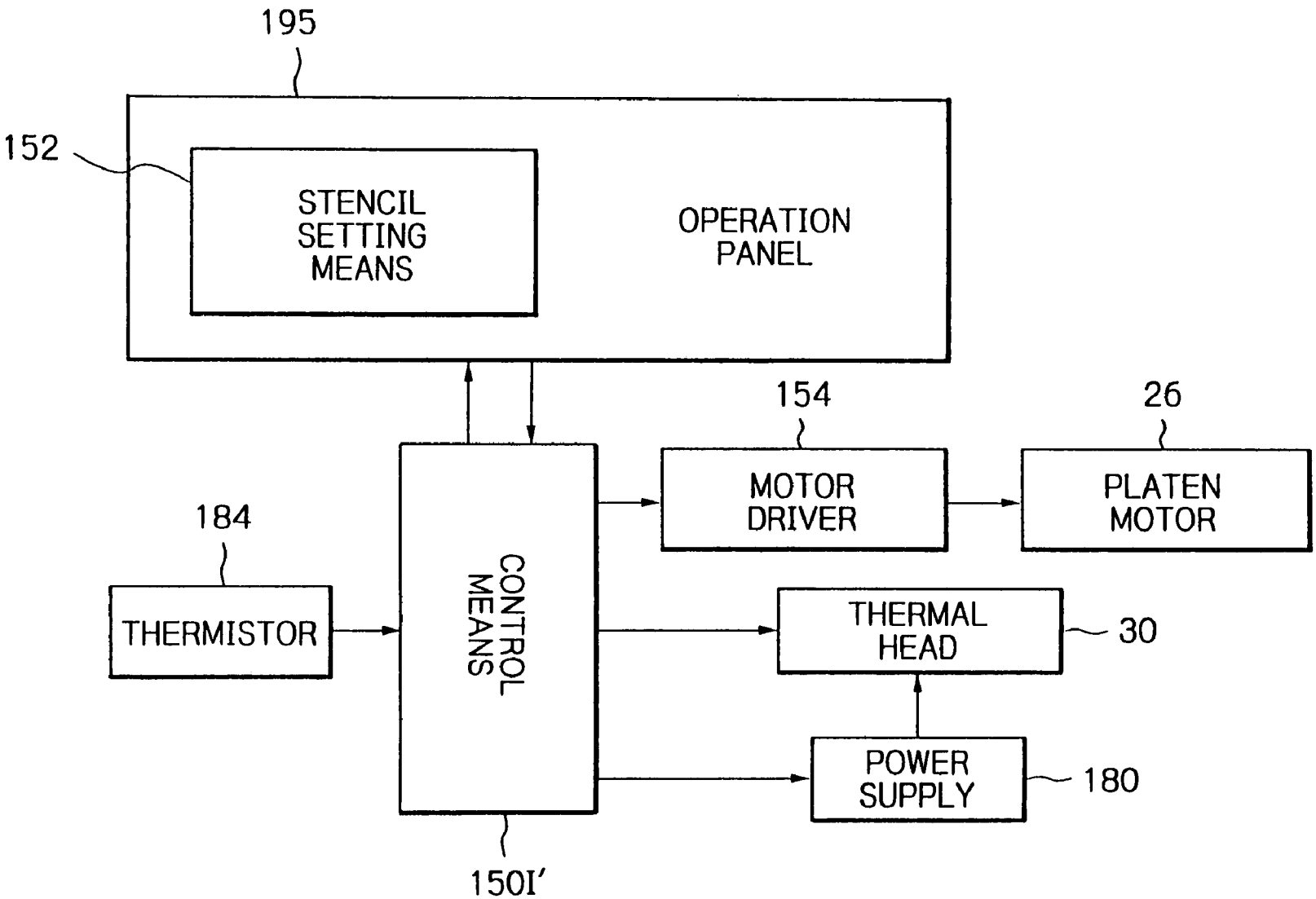
FIG. 32 is a block diagram showing a twenty-second embodiment of the present invention.
Figure 33:
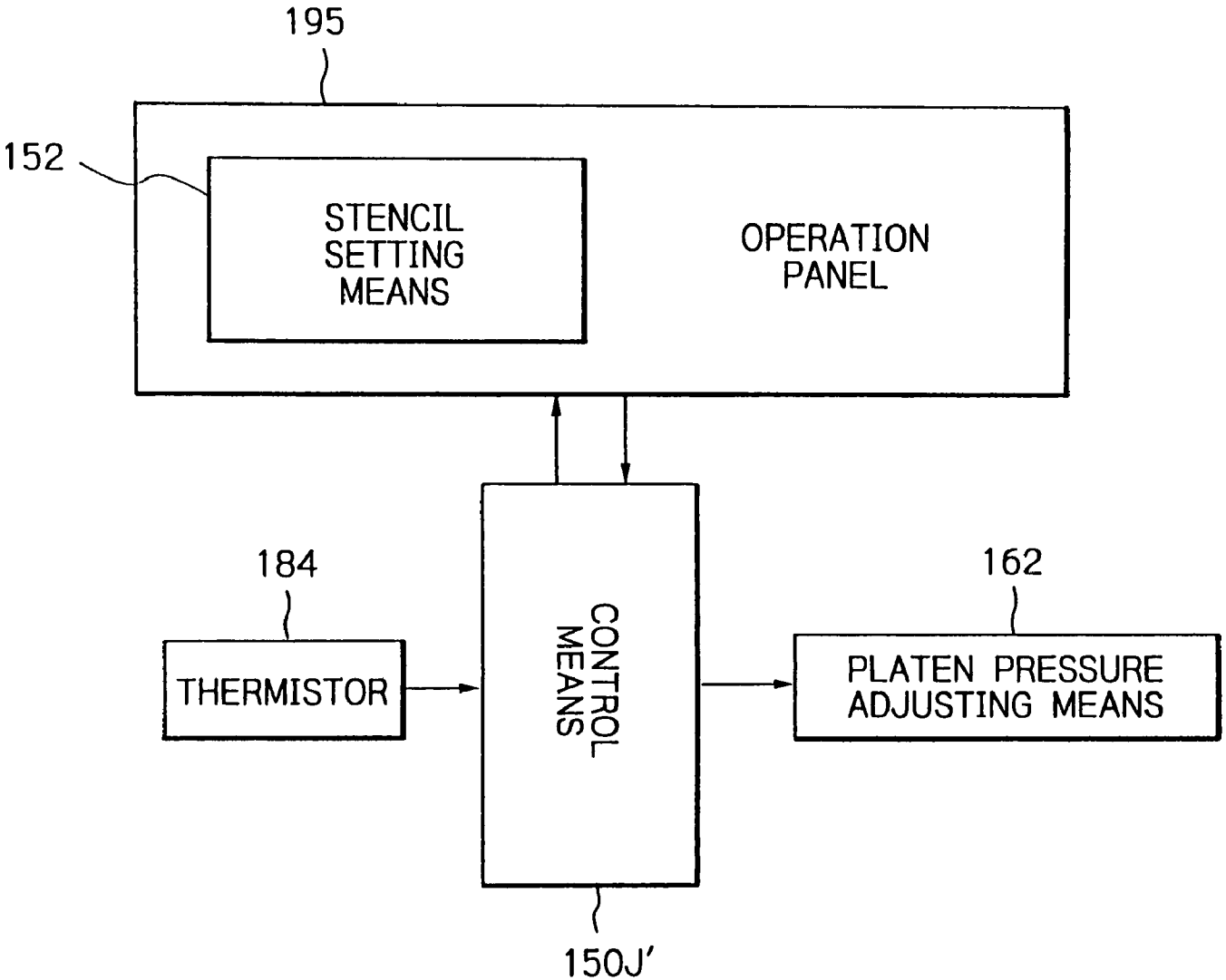
FIG. 33 is a block diagram showing a twenty-third embodiment of the present invention.
Figure 34:
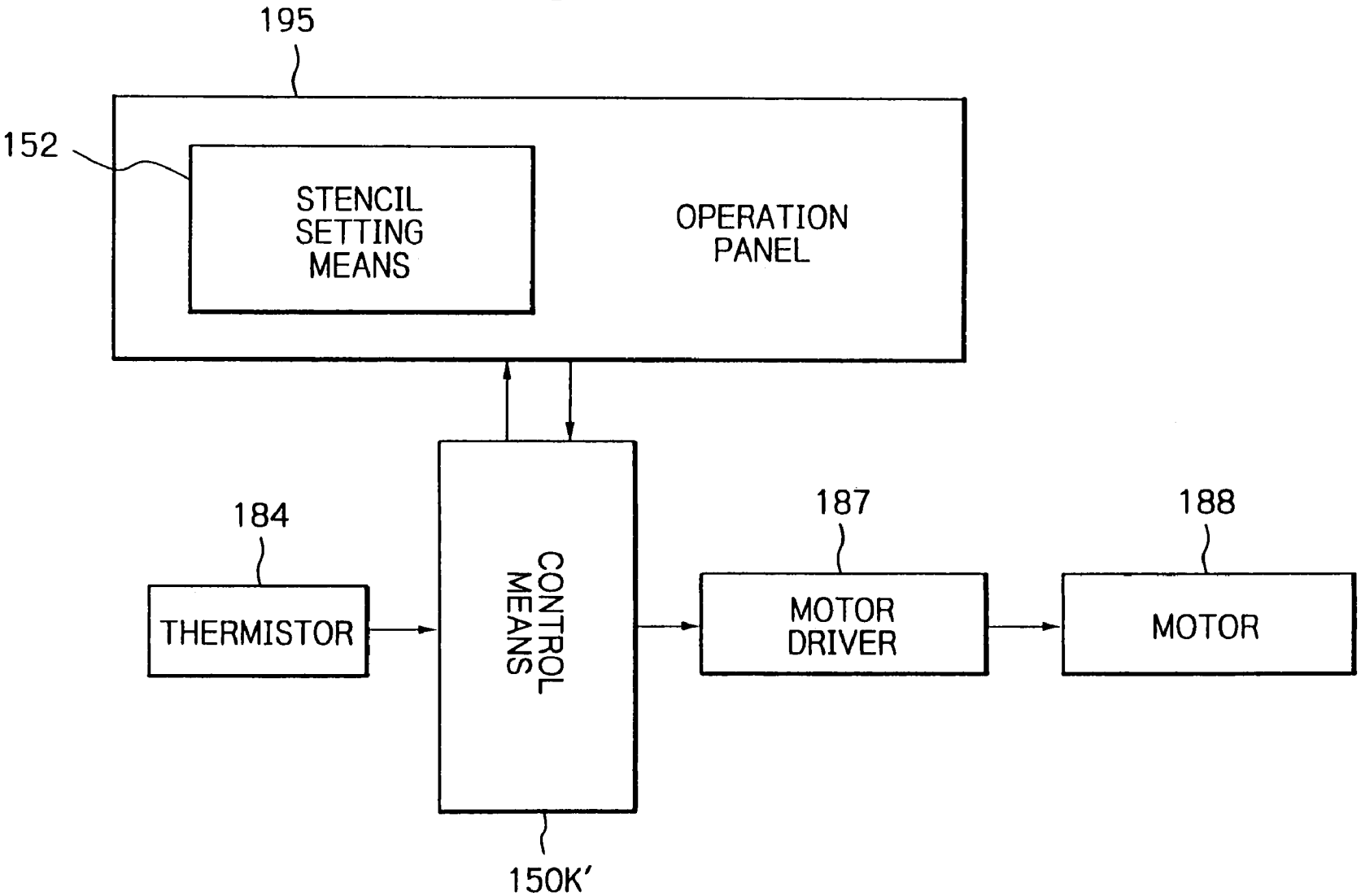
FIG. 34 is a schematic block diagram showing a twenty-fourth embodiment of the present invention.
Figure 35:
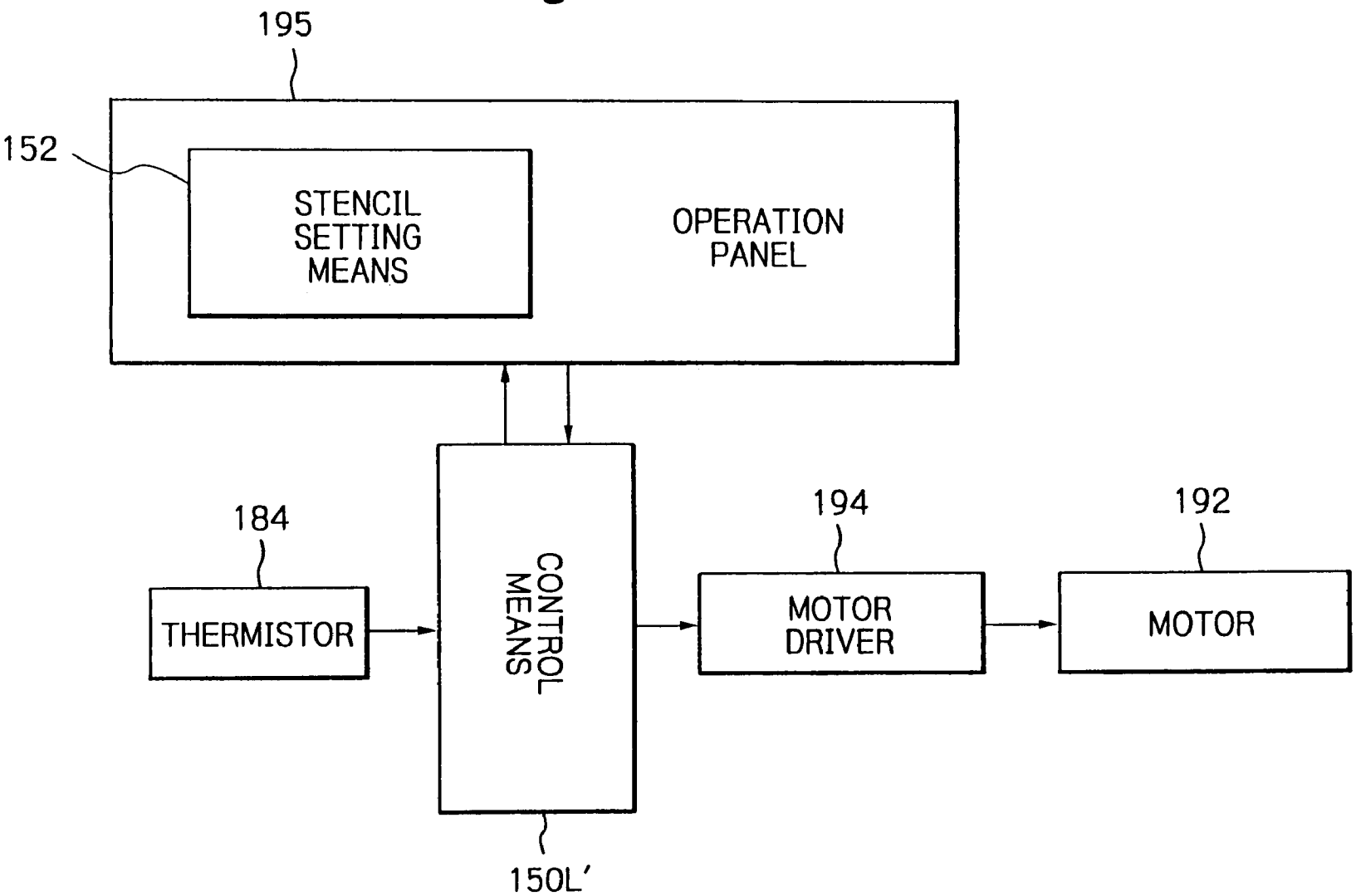
FIG. 35 is a schematic block diagram showing a twenty-fifth embodiment of the present invention.
Figure 36:
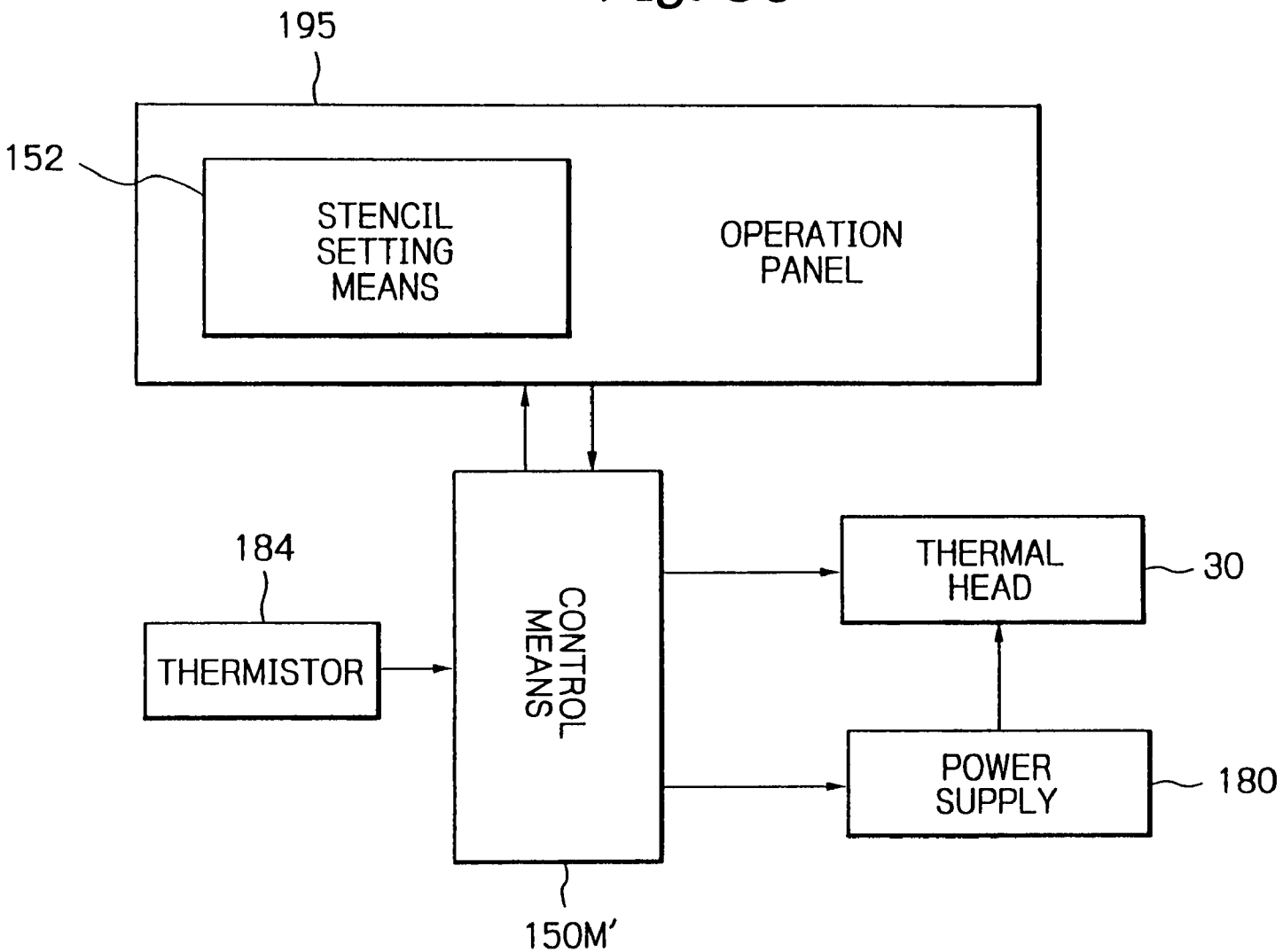
FIG. 36 is a schematic block diagram showing a twenty-sixth embodiment of the present invention.

FIG. 32 shows a twenty-second embodiment of the present invention in which control means 150I' adjusts a master making speed as in the ninth embodiment. FIG. 33 shows a twenty-third embodiment of the present invention in which control means 150J' adjusts the platen pressure as in the tenth embodiment. FIG. 34 shows a twenty-fourth embodiment of the present invention in which control means 150K' controls the front tension of the stencil 61 as in the eleventh embodiment. FIG. 35 shows a twenty-fifth embodiment of the present invention in which control means 150K' controls the back tension of the stencil 61 as in the twelfth embodiment. Further, FIG. 36 shows a twenty-sixth embodiment of the present invention in which control means 150M' adjusts energy to be applied to the thermal head 30 as in the thirteenth embodiment.

Again, the illustrative embodiments shown and described each may sense any other environmental condition, e.g., humidity in addition to temperature.

Figure 37:
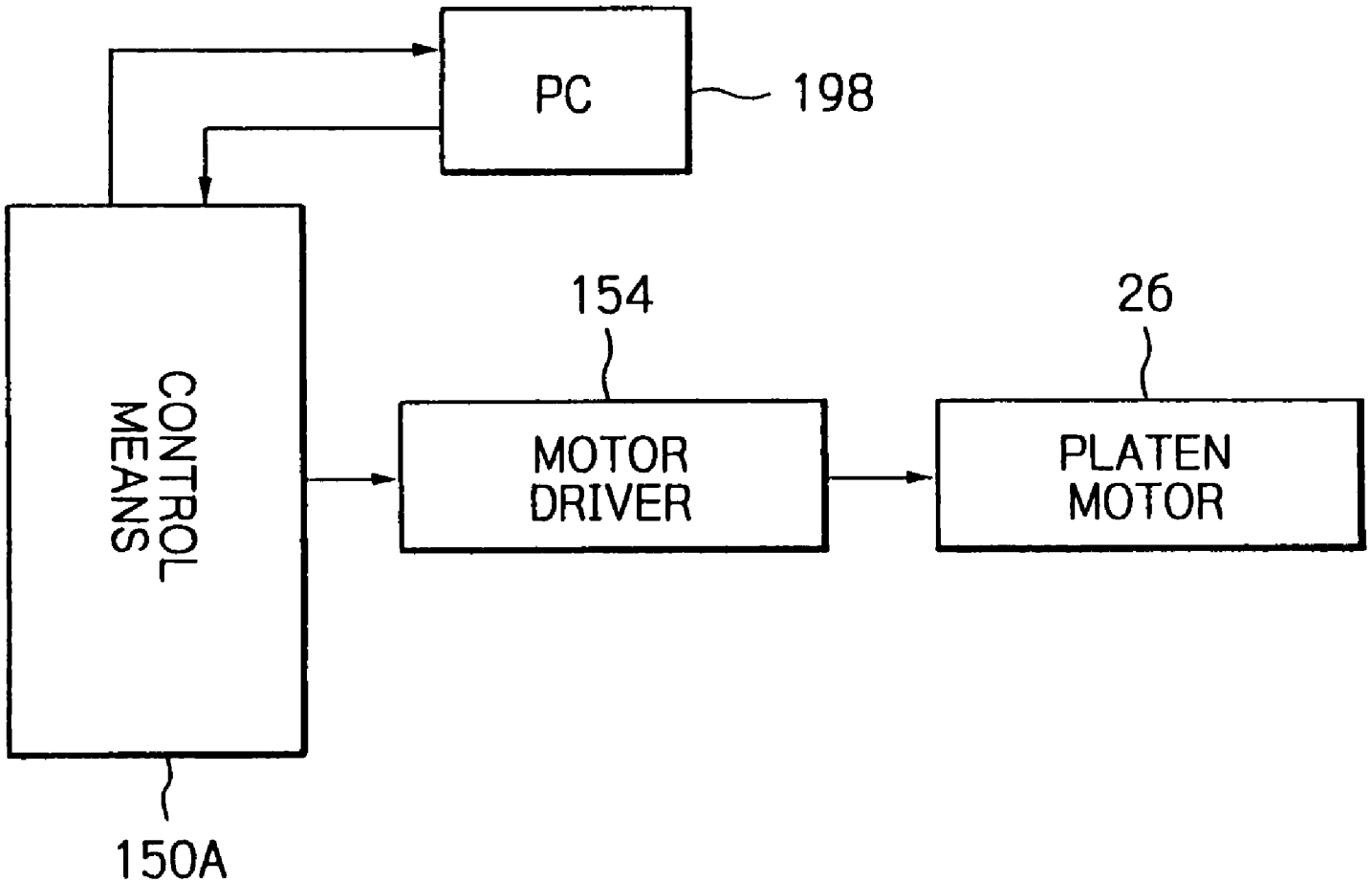
FIG. 37 is a schematic block diagram showing a twenty-seventh embodiment of the present invention.

FIG. 37 shows a twenty-seventh embodiment of the present invention. As shown, the function of the master setting device 152 is assigned to a personal computer or host 198 connected to the stencil printer as alternative stencil setting means.

The fourteenth to twenty-seventh embodiments each control only one of the master making speed, master conveying speed, platen pressure, energy and so forth. Such different control procedures should preferably be executed in series so as to further promote accurate control, as will be described specifically with reference to FIG. 38. As shown, an environmental condition is determined on the basis of the output of the thermistor 184 or similar environment condition sensing means (step S1). The operator inputs the kind of the stencil to use on the stencil setting means 152 (step S3). The control means 150' determines the kind of the stencil in accordance with the output of the stencil setting means 153 (step S3). Steps S4 through S23 following the step S3 are respectively identical with the steps S3 through S22 shown in FIG. 22 and will not be described specifically in order to avoid redundancy.

As stated above, the fourteenth to twenty-seventh embodiments each include the stencil setting means implemented as an LCD and keys arranged on the operation panel of the printer body. The stencil setting means therefore does not increase the overall size of the printer or makes circuitry sophisticated. Alternatively, the stencil setting means may be implemented as, e.g., a personal computer or similar host connected to the printer body, enhancing easy operation and diversification. The above illustrative embodiments, of course, achieve the advantages described with reference to the first to thirteenth embodiments as well.

Various modifications will become possible for those skilled in the art after receiving the present disclosure without departing from the scope thereof.

What is claimed is:

1. A stencil printer for perforating a thermosensitive stencil with heating means to thereby make a master, said stencil printer comprising:

a platen roller for conveying the stencil, said platen roller facing the heating means;

stencil setting means for allowing an operator of said stencil printer to set a kind of the stencil using an input/output device, said kind of the stencil includes information regarding a perforation sensitivity of the stencil; and adjusting means for selecting, among master making conditions experimentally determined beforehand, a master making condition matching with information output from said stencil setting means, wherein said adjusting means adjusts a master making speed of the platen roller in accordance with said information, and wherein when the perforation sensitivity of the stencil is low, data indicative of a low master making speed is selected, and when the perforation sensitivity is standard, data indicative of a standard master making speed is selected.

2. The stencil printer as claimed in claim 1, wherein said adjusting means adjusts, based on said information, a speed at which the stencil is conveyed.

3. The stencil printer as claimed in claim 1, wherein said heating means comprises a thermal head.

4. The stencil printer as claimed in claim 1, wherein said heating means comprises a thermal head, a platen pressure for pressing the stencil against said thermal head is adjustable, and said adjusting means adjusts the platen pressure in accordance with said information.

5. The stencil printer as claimed in claim 1, wherein said heating means comprises a thermal head, said stencil printer further comprises a feed roller pair located downstream of said platen roller in a direction of stencil conveyance for adjusting a front tension of said stencil, and said adjusting means adjusts the front tension in accordance with said information.

6. The stencil printer as claimed in claim 1, wherein said heating means comprises a thermal head, said stencil printer further comprises a feed roller pair located upstream of said platen roller in a direction of stencil conveyance for adjusting a back tension of said stencil, and said adjusting means adjusts the back tension in accordance with said information.

7. The stencil printer as claimed in claim 1, wherein said heating means comprises a thermal head, and said adjusting means adjusts energy to be applied to said thermal head in accordance with said information.

8. The stencil printer as claimed in claim 1, wherein said heating means comprises a thermal head, said stencil printer further comprises temperature sensing means for sensing a temperature of said thermal head, and said adjusting means adjusts energy to be applied to said thermal head in accordance with said information and information output from said temperature sensing means.

9. The stencil printer as claimed in claim 1, wherein said input/output device comprises:

an LCD (Liquid Crystal Display) positioned on an operation panel, which is mounted on a printer body, for displaying the kind of the stencil; and keys arranged on said operation panel for allowing the operator to set the kind of the stencil.

10. The stencil printer as claimed in claim 1, wherein said input/output device comprises a host connected to said stencil printer.

11. A stencil printer for perforating a thermosensitive stencil with a heating device to thereby make a master, said stencil printer comprising:

a platen roller configured to convey the stencil, said platen roller facing the heating device;

a stencil setting device configured to allow an operator of said stencil printer to set a kind of the stencil using an input/output device, said kind of the stencil includes information regarding a perforation sensitivity of the stencil; and an adjusting device configured to select, among master making conditions experimentally determined beforehand, a master making condition matching with information output from said stencil setting device, wherein said adjusting device adjusts a master making speed of the platen in accordance with said information, and wherein when the perforation sensitivity of the stencil is low, data indicative of a low master making speed is selected, and when the perforation sensitivity is standard, data indicative of a standard master making speed is selected.

12. The stencil printer as claimed in claim 11, wherein said adjusting device adjusts, based on said information, a speed at which the stencil is conveyed.

13. The stencil printer as claimed in claim 11, wherein said heating device comprises a thermal head.

14. The stencil printer as claimed in claim 11, wherein said heating device comprises a thermal head, a platen pressure for pressing the stencil against said thermal head is adjustable, and said adjusting device adjusts the platen pressure in accordance with said information.

15. The stencil printer as claimed in claim 11, wherein said heating device comprises a thermal head, said stencil printer further comprises a feed roller pair located downstream of said platen roller in a direction of stencil conveyance for adjusting a front tension of said stencil, and said adjusting device adjusts the front tension in accordance with said information.

16. The stencil printer as claimed in claim 11, wherein said heating device comprises a thermal head, said stencil printer further comprises a feed roller pair located upstream of said platen roller in a direction of stencil conveyance for adjusting a back tension of said stencil, and said adjusting device adjusts the back tension in accordance with said information.

17. The stencil printer as claimed in claim 11, wherein said heating device comprises a thermal head, and said adjusting device adjusts energy to be applied to said thermal head in accordance with said information.

18. The stencil printer as claimed in claim 11, wherein said heating device comprises a thermal head, said stencil printer further comprises a temperature sensor responsive to a temperature of said thermal head, and said adjusting device adjusts energy to be applied to said thermal head in accordance with said information and information output from said temperature sensor.

19. The stencil printer as claimed in claim 11, wherein said input/output device comprises:

an LCD positioned on an operation panel, which is mounted on a printer body, for displaying the kind of the stencil; and keys arranged on said operation panel for allowing the operator to set the kind of the stencil.

20. The stencil printer as claimed in claim 11, wherein said input/output device comprises a host connected to said stencil printer.

* * * * *

UNITED STATES PATENT AND TRADEMARK OFFICE

CERTIFICATE OF CORRECTION

PATENT NO. : 7,444,933 B2
APPLICATION NO. : 10/898331
DATED : November 4, 2008
INVENTOR(S) : Yasunobu Kidoura et al.

It is certified that error appears in the above-identified patent and that said Letters Patent is hereby corrected as shown below:

Column 12, Line 23, change “1501” to --150I--.

Signed and Sealed this

Fourteenth Day of April, 2009

JOHN DOLL
*Acting Director of the United States Patent and Trademark Office*